US010024309B2

(12) United States Patent
Michel

(10) Patent No.: US 10,024,309 B2
(45) Date of Patent: Jul. 17, 2018

(54) RECIPROCATING PUMPS FOR DOWNHOLE DELIQUIFICATION SYSTEMS AND PISTONS FOR RECIPROCATING PUMPS

(71) Applicant: William Michel, Etival Clairefontaine (FR)

(72) Inventor: William Michel, Etival Clairefontaine (FR)

(73) Assignee: BP CORPORATION NORTH AMERICA, INC., Houston, TX (US)

( * ) Notice: Subject to any disclaimer, the term of this patent is extended or adjusted under 35 U.S.C. 154(b) by 464 days.

(21) Appl. No.: 14/686,920

(22) Filed: Apr. 15, 2015

(65) Prior Publication Data

US 2015/0300330 A1 Oct. 22, 2015

Related U.S. Application Data

(60) Provisional application No. 61/980,106, filed on Apr. 16, 2014.

(51) Int. Cl.
*E21B 43/12* (2006.01)
*F04B 43/113* (2006.01)
(Continued)

(52) U.S. Cl.
CPC ..... *F04B 1/02* (2013.01); *E21B 43/129* (2013.01); *E21B 43/38* (2013.01); *F04B 9/111* (2013.01); *F04B 9/115* (2013.01); *F04B 53/12* (2013.01); *F04B 53/127* (2013.01); *F04B 53/129* (2013.01); *F04B 53/14* (2013.01); *F15B 15/225* (2013.01); *F04B 47/08* (2013.01); *F15B 2211/755* (2013.01); *F15B 2211/77* (2013.01);
(Continued)

(58) Field of Classification Search
None
See application file for complete search history.

(56) References Cited

U.S. PATENT DOCUMENTS 2,443,344 A * 6/1948 Ekleberry ..... F04B 25/02 417/261
2,948,224 A * 8/1960 Bailey ..... F04B 47/04 417/393
(Continued)

OTHER PUBLICATIONS

European Office Action dated Jul. 25, 2016, for European Application No. 15163938.2 (2834-11203) (4 p.).

*Primary Examiner* — Peter J Bertheaud
*Assistant Examiner* — Geoffrey Lee
(74) *Attorney, Agent, or Firm* — Conley Rose, P.C.

(57) ABSTRACT

A piston includes a piston housing and a decompression valve disposed in the piston housing. The decompression valve includes a valve housing seated in the piston housing and a valve member moveably received by the valve housing. The valve member has a radially outer surface including an annular shoulder. In addition, the piston includes an end cap secured to the first end of the piston housing. A radially inner surface of the end cap includes an annular valve seat. The decompression valve has a closed position with the annular shoulder of the valve member engaging the valve seat of the end cap and an open position with the annular shoulder of the valve member axially spaced from the valve seat of the end cap. The piston also includes a biasing member configured to bias the decompression valve to the closed position.

9 Claims, 19 Drawing Sheets

(51) Int. Cl.

| | |
|---|---|
| ***F04B 1/02*** | (2006.01) |
| ***F04B 19/22*** | (2006.01) |
| ***F04B 47/00*** | (2006.01) |
| ***F04B 53/10*** | (2006.01) |
| ***F04B 53/14*** | (2006.01) |
| ***F16J 1/00*** | (2006.01) |
| ***F16K 1/00*** | (2006.01) |
| ***F04B 9/111*** | (2006.01) |
| ***F04B 9/115*** | (2006.01) |
| ***F04B 53/12*** | (2006.01) |
| ***F15B 15/22*** | (2006.01) |
| ***E21B 43/38*** | (2006.01) |
| *F04B 47/08* | (2006.01) |

(52) U.S. Cl.
CPC . *F15B 2211/7725* (2013.01); *F15B 2211/853* (2013.01)

(56) References Cited

U.S. PATENT DOCUMENTS 3,152,016 A * 10/1964 Drushella ..... F01L 23/00 417/397
3,703,926 A * 11/1972 Roeder ..... F04B 9/10 166/106
4,295,801 A * 10/1981 Bennett ..... E21B 49/084 417/390
4,627,794 A * 12/1986 Silva ..... F01L 23/00 417/225
5,249,936 A * 10/1993 McConnell ..... F16K 15/04 417/444
5,829,952 A * 11/1998 Shadden ..... E21B 34/06 137/533.25
6,347,668 B1 * 2/2002 McNeill ..... E21B 21/10 166/105
7,281,464 B2 * 10/2007 Weiler, Jr. ..... C25C 3/14 91/44
8,303,272 B2 * 11/2012 Pugh ..... E21B 43/129 417/401
8,511,390 B2 * 8/2013 Coyle ..... E21B 43/121 166/369
2005/0053503 A1 * 3/2005 Gallant ..... F04B 47/00 417/510
2007/0186763 A1 * 8/2007 Weiler, Jr. ..... C25C 3/14 91/392
2008/0283250 A1 * 11/2008 Simmons ..... E21B 43/121 166/369
2009/0078110 A1 * 3/2009 Waldmann ..... F15B 11/064 91/403
2011/0186302 A1 * 8/2011 Coyle ..... E21B 43/121 166/372
2013/0243630 A1 * 9/2013 Simmons ..... F04B 23/028 417/456
2013/0299182 A1 * 11/2013 Coyle ..... E21B 43/121 166/372

* cited by examiner

RECIPROCATING PUMPS FOR DOWNHOLE DELIQUIFICATION SYSTEMS AND PISTONS FOR RECIPROCATING PUMPS

CROSS-REFERENCE TO RELATED APPLICATIONS

This application claims benefit of U.S. provisional patent application Ser. No. 61/980,106 filed Apr. 16, 2014, and entitled "Reciprocating Pumps for Downhole Deliquification Systems and Pistons for Reciprocating Pumps," which is hereby incorporated herein by reference in its entirety.

STATEMENT REGARDING FEDERALLY SPONSORED RESEARCH OR DEVELOPMENT

Not applicable.

BACKGROUND

Embodiments described herein generally relate to downhole pumping systems and methods. More particularly, embodiments described herein relate to systems and methods for deliquifying subterranean gas wells to enhance production.

Geological structures that yield gas typically produce water and other liquids that accumulate at the bottom of the wellbore. The liquids typically comprise hydrocarbon condensate (e.g., relatively light gravity oil) and interstitial water in the reservoir. The liquids accumulate in the wellbore in two forms, both as single phase liquid entering from the reservoir and as condensing liquids, falling back in the wellbore. The condensing liquids actually enter the wellbore as a vapor and as they travel up the wellbore, they drop below their respective dew points and condense. In either case, the higher density liquid-phase, being essentially discontinuous, must be transported to the surface by the gas.

In some hydrocarbon producing wells that produce both gas and liquid, the formation gas pressure and volumetric flow rate are sufficient to lift the produced liquids to the surface. In such wells, accumulation of liquids in the wellbore generally does not hinder gas production. However, in the event the gas phase does not provide sufficient transport energy to lift the liquids out of the well (i.e. the formation gas pressure and volumetric flow rate are not sufficient to lift the produced liquids to the surface), the liquid will accumulate in the well bore.

In many cases, the hydrocarbon well may initially produce gas with sufficient pressure and volumetric flow to lift produced liquids to the surface, however, over time, the produced gas pressure and volumetric flow rate decrease until they are no longer capable of lifting the produced liquids to the surface. Specifically, as the life of a natural gas well matures, reservoir pressures that drive gas production to surface decline, resulting in lower production. At some point, the gas velocities drop below the "Critical Velocity" (CV), which is the minimum velocity required to carry a droplet of water to the surface. As time progresses these droplets accumulate in the bottom of the wellbore. The accumulation of liquids in the well impose an additional back-pressure on the formation and may begin to cover the gas producing portion of the formation and detrimentally affect the production capacity of the well. Once the liquid will no longer flow with the produced gas to the surface, the well will eventually become "loaded" as the liquid hydrostatic head begins to overcome the lifting action of the gas flow, at which point the well is "killed" or "shuts itself in."

Thus, the accumulation of liquids such as water in a natural gas well tends to reduce the quantity of natural gas that can be produced from the well. Consequently, it may become necessary to use artificial lift techniques to remove the accumulated liquid from the wellbore to restore the flow of gas from the formation. The process for removing such accumulated liquids from a wellbore is commonly referred to as "deliquification."

For oil wells that primarily produce single phase liquids (oil and water) with a minimal amount of entrained gas, there are numerous artificial lift techniques. The most commonly employed type of artificial lift requires pulling 30 foot tubing joints from the well, attaching a fluid pump to the lowermost joint, and running the pump downhole on the string of tubing joints. The fluid pump may be driven by jointed rods attached to a beam pump, a downhole electric motor supplied with electrical power from the surface via wires banded to the outside of the tubing string, or a surface hydraulic pump displacing a power fluid to the downhole fluid pump via multiple hydraulic lines. Although there are several types of artificial lift used in lifting oil, they usually require an expensive method of deployment consisting of workover rigs, coiled tubing units, cable spoolers, and multiple personnel on-site.

Initially, artificial lift techniques employed with oil producing wells were used to deliquify gas producing wells (i.e., remove liquids from gas producing wells). However, the adaptation of existing oilfield artificial lift technologies for gas producing wells generated a whole new set of challenges. The first challenge was commercial. When employing artificial lift techniques in an oil well, revenue is immediately generated—valuable oil is lifted to the surface. In contrast, when deliquifying a gas well, additional expense is generated mostly from non-revenue generating liquids—typically, water and small amounts of condensed light hydrocarbons are lifted to the surface. The benefit, however, is the ability to maintain and potentially increase the production of gas for extended time, thereby creating additional recoverable reserves. Typically, at 100 psi downhole pressure, the critical velocity, and hence need for artificial lift, occurs at less than 300 mcfd. One challenge is that large remaining reserve potentials with lower per well revenue streams are needed to justify the price of installing traditional artificial lift technologies.

The second major shortcoming of the existing artificial lift technologies is the lack of design for dealing with three phase flow, with the largest percentage being the gas phase. For example, many conventional artificial lift pumps gas lock or cavitate when pumping fluids comprising more than about 30% gas by volume. However, in many gas wells, the pump may experience churn fluid flow where the pump intake may experience transitions between 100% gas and 100% liquid over a few seconds. In general, the goal of a downhole fluid pump is to physically lower the fluid level or hydrostatic in the wellbore as close to the pump intake as possible. Unfortunately, most conventional artificial lift technologies cannot achieve this goal and thus are not fit for purpose.

With well economics driving limited choices for deliquification, one lower cost option that has been investigated is called "plunger lift." In a plunger lift system, a solid round metal plug is placed inside the tubing at the bottom of the well, and liquids are allowed to accumulate on top of the plug. Then a controller shuts in the well via a shutoff valve and allows pressure to build, and then releases the plunger to come to surface, pushing the fluids above it. When the shutoff valve is closed, the pressure at the bottom of the well usually builds up slowly over time as fluids and gas pass from the formation into the well. When the shutoff valve is opened, the pressure at the well head is lower than the bottomhole pressure, so that the pressure differential causes the plunger to travel to the surface. Plunger lift is basically a cyclic "bucketing" of fluids to surface. Since the driver is the wellbore pressure it is directly proportional to the amount of liquid it can lift. Also, the older the well, the longer shut-in times are required to build pressure. Besides the safety risks of launching a metal plug to surface at velocities around 1,000 feet per minute, the plunger requires high manual intervention and only removes a small fraction of the liquid column to surface.

BRIEF SUMMARY OF THE DISCLOSURE

In one embodiment described herein, a piston comprises a piston housing having a central axis, a first end, a second end, a radially outer surface extending axially from the first end to the second end, and a radially inner surface extending from the first end to the second end. In addition, the piston comprises a decompression valve disposed in the piston housing. The decompression valve includes a valve housing seated in the piston housing and a valve member moveably received by the valve housing. The valve member has a radially outer surface including an annular shoulder. Further, the piston comprises an end cap secured to the first end of the piston housing. The end cap has a first end, a second end opposite the first end, and a radially inner surface extending from the first end of the end cap to the second end of the end cap. The radially inner surface of the end cap includes an annular valve seat. The decompression valve has a closed position with the annular shoulder of the valve member engaging the valve seat of the end cap and an open position with the annular shoulder of the valve member axially spaced from the valve seat of the end cap. Still further, the piston comprises a biasing member disposed within the valve housing and configured to bias the annular shoulder of the valve member into engagement with the valve seat of the end cap.

In another embodiment described herein, a reciprocating pump for pumping a fluid comprises a pump housing having a central axis, a first end, a second end opposite the first end, a first piston chamber, and a second piston chamber axially spaced from the first piston chamber. In addition, the reciprocating pump comprises a first valve assembly coupled to the first end of the pump housing. The first valve assembly includes an inlet valve and an outlet valve. Further, the reciprocating pump comprises a second valve assembly coupled to the second end of the pump housing. The second valve assembly includes an inlet valve and an outlet valve. Still further, the reciprocating pump comprises a first piston moveably disposed in the first piston chamber. The first piston divides the first piston chamber into a first section extending axially from the first piston to the first valve assembly and a second section axially positioned between the first piston and the second piston. The inlet valve of the first valve assembly is configured to supply the fluid to the first section of the first piston chamber and the outlet valve of the first valve assembly is configured to exhaust the fluid from the first section of the first piston chamber. Moreover, the reciprocating pump comprises a second piston moveably disposed in the second piston chamber. The second piston divides the second piston chamber into a first section extending axially from the second piston to the second valve assembly and a second section axially positioned between the second piston and the first piston. The inlet valve of the second valve assembly is configured to supply the fluid to the first section of the second piston chamber and the outlet valve of the second valve assembly is configured to exhaust the fluid from the first section of the second piston chamber. The reciprocating pump also comprises a connecting rod extending axially through the pump housing. The connecting rod has a first end coupled to the first piston, a second end coupled to the second piston, and a throughbore extending axially from the first end to the second end of the connecting rod. Each piston includes a piston housing and a decompression valve disposed in the piston housing. The decompression valve of the first piston has a closed position preventing fluid communication between the first section of the first piston chamber and the throughbore of the connecting rod and an open position allowing fluid communication between the first section of the first piston chamber and the throughbore of the connecting rod and a closed position. The decompression valve of the first piston is biased to the closed position. The decompression valve of the second piston has a closed position preventing fluid communication between the first section of the first piston chamber and the throughbore of the connecting rod and an open position allowing fluid communication between the first section of the first piston chamber and the throughbore of the connecting rod and a closed position. The decompression valve of the second piston is biased to the closed position. The decompression valve of the first piston includes a valve member extending axially from the piston housing of the first piston and configured to axially impact the first valve assembly to transition the decompression valve of the first piston to the open position. The decompression valve of the second piston includes a valve member extending axially from the piston housing of the second piston and configured to axially impact the second valve assembly to transition the decompression valve of the second piston to the open position.

In yet another embodiment described herein, a reciprocating pump for pumping a fluid comprises a pump housing having a central axis, a first end, a second end opposite the first end, and a first piston chamber. In addition, the reciprocating pump comprises a first piston moveably disposed in the first piston chamber. The first piston divides the first piston chamber into a first section and a second section disposed on axially opposite sides of the first piston. Further, the reciprocating pump comprises a connecting rod extending axially through the second section. The connecting rod has a first end coupled to the first piston, a second end axially opposite the first end of the connecting rod, and a throughbore extending axially from the first end of the connecting rod to the second end of the connecting rod. The first piston has a first end, a second end axially opposite the first end of the first piston, a radially outer surface extending axially from the first end of the first piston to the second end of the first piston, and a radially inner surface extending axially from the first end of the first piston to the second end of the first piston. The first piston includes an annular recess on the outer surface of the first piston and a drain port extending radially from the annular recess of the first piston, wherein the annular recess and the drain port of the first piston are in fluid communication with the throughbore of the connecting rod.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF SOME OF THE PREFERRED EMBODIMENTS

Figure 1:
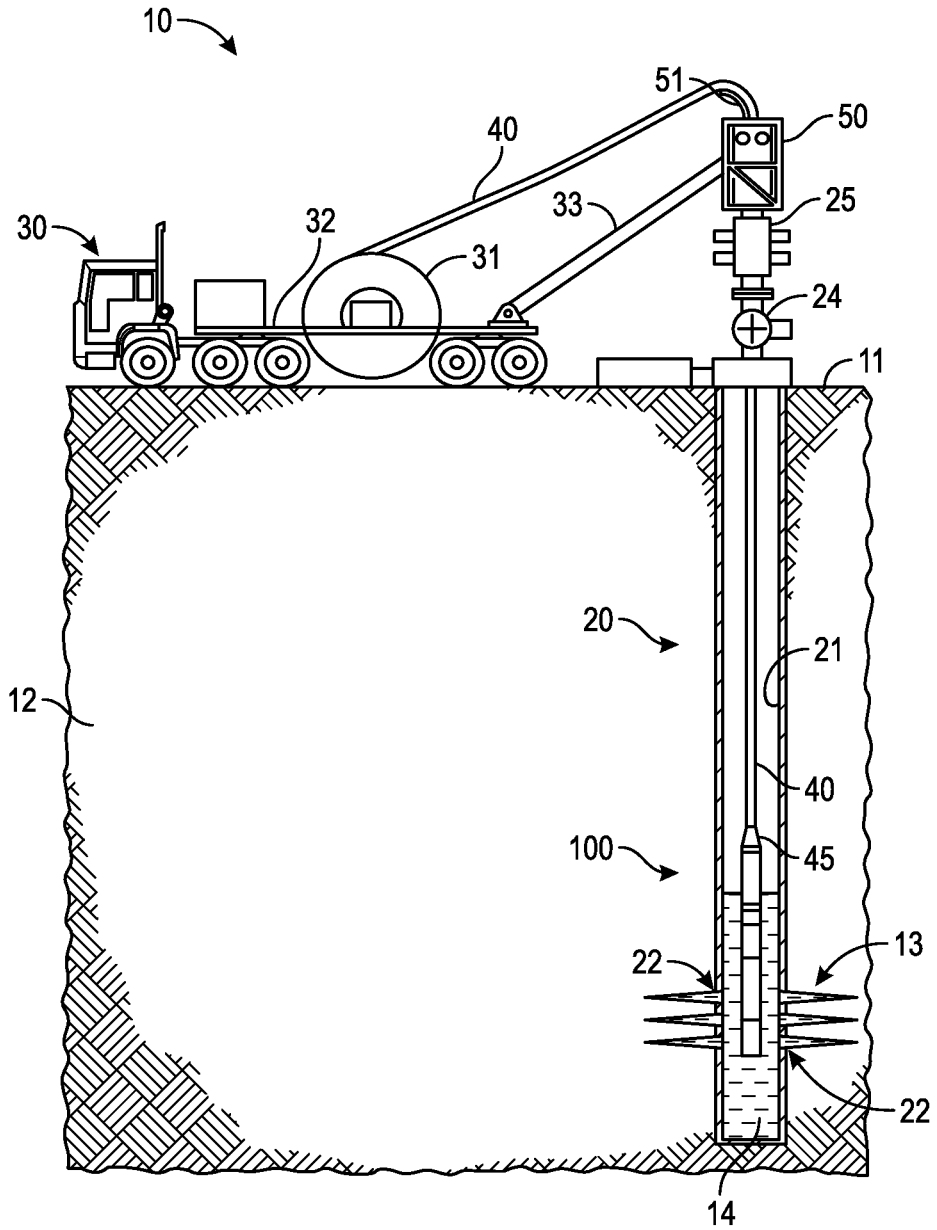
FIG. 1 is a schematic view of an embodiment of a rigless system for deliquifying a hydrocarbon producing well.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

As previously described, the accumulation of liquids such as water in a natural gas well tends to reduce the quantity of natural gas that can be produced from the well. Consequently, artificial lift techniques may be necessary to remove the accumulated liquid from the wellbore to restore the flow of gas from the formation. However, many conventional artificial lift techniques are cost prohibitive, require complicated deployment operations, are not suited for handling three phase flow, present safety risks, or are inefficient (e.g., only removes a small fraction of the liquid column to surface). Accordingly, there is a need in the art for improved systems and methods for deliquifying wells. Embodiments described herein are designed and configured to address the various shortcomings associated with certain prior devices, systems, and methods.

Referring now to FIG. 1, an embodiment of a rigless deliquification system 10 for deliquifying a hydrocarbon producing wellbore 20 is shown. In this embodiment, system 10 includes a mobile deployment vehicle 30 at the surface 11, conduit 40, an injector head 50, and a deliquification pump 100. Deployment vehicle 30 has a spool or reel 31 for storing, transporting, and deploying conduit 40. Specifically, conduit 40 is a long, continuous conduit wound on reel 31. Conduit 40 is straightened prior to being pushed into wellbore 20 and rewound to coil conduit 40 back onto reel 31. Deliquification pump 100 is coupled to the lower end of conduit 40 with a connector 45 and is controllably positioned in wellbore 20 with conduit 40.

Wellbore 20 traverses an earthen formation 12 comprising a production zone 13. Casing 21 lines wellbore 20 and includes perforations 22 that allow fluids 14 (e.g., water, gas, etc.) to pass from production zone 13 into wellbore 20. System 10 extends into wellbore 20 through an injector head 50 coupled to a wellhead 24 from which casing 21 extends. In this embodiment, a blowout preventer 25 sits atop wellhead 24, and thus, system 10 extends through injector head 50, blowout preventer 25, and wellhead 24 into casing 21.

As shown in FIG. 1, deployment vehicle 30 is parked adjacent to wellhead 24 at the surface 11. Deliquification pump 100 is coupled to conduit 40 and lowered into wellbore 20 by controlling reel 31. In general, pump 100 may be coupled to conduit 40 before or after passing conduit 40 through injector head 50, BOP 25, and wellhead 21. Conduit 40 is unreeled until deliquification pump 100 is positioned at the bottom of wellbore 20. Using conduit 40, pump 100 may be deployed to depths in excess of 3,000 ft., and in some cases, depths in excess of 8,000 ft. or even 10,000 ft. Accordingly, pump 100 is preferably designed to withstand the harsh downhole conditions at such depths.

During deliquification operations, fluids 14 in the bottom of wellbore 20 are pumped through conduit 40 to the surface 11 with pump 100. In general, system 10 may be employed to lift and remove fluids from any type of well including, without limitation, oil producing wells, natural gas producing wells, methane producing wells, propane producing wells, or combinations thereof. However, embodiments of system 10 described herein are particularly suited for deliquification of gas wells. In this embodiment, wellbore 20 is gas well, and thus, fluids 14 include water, hydrocarbon condensate, gas, and possibly small amounts of oil. Pump 100 may remain deployed in well 20 for the life of the well 20, or alternatively, be removed from well 20 once production of well 20 has been re-established. To enhance the volumetric flow rate of well fluids 14 removed from wellbore 20 and pumped to the surface 11, pump 100 preferably has an outer diameter that is maximized or as large as reasonably possible relative to the inner diameter of casing 21.

It should be appreciated that deployment of system 10 and deliquification pump 100 via vehicle 30 eliminates the need for construction and/or use of a rig. In other words, system 10 and pump 100 may be deployed in a "rigless" manner. As used herein, the term "rigless" is used to refer to an operation, process, apparatus or system that does not require the construction or use of a workover rig that includes the derrick or mast, and the drawworks. By eliminating the need for a workover rig for deployment, system 10 offers the potential to provide a more economically feasible means for deliquifying relatively low production gas wells.

Referring still to FIG. 1, in this embodiment, rigless deployment vehicle 30 is a mobile unit capable of transporting system 10 from site-to-site on roads and highways. In particular, rigless deployment vehicle 30 is a truck including a trailer 32 and mast 33. Reel 31 is rotatably mounted to trailer 32, and mast 33 is rotatably and pivotally coupled to trailer 32. Injector head 50 is coupled to the distal end of mast 33 and is positioned atop wellhead 20 with mast 33. In this embodiment, injector head 50 includes a gooseneck 51 that facilitates the alignment of conduit 40 with injector head 50 and wellhead 24. The rotation of reel 31 and positioning of mast 33 may be powered by any suitable means including, without limitation, an internal combustion engine (e.g., the engine of truck 30), an electric motor, a hydraulic motor, or combinations thereof. Since vehicle 30 is designed to travel existing highways and roads, vehicle 30 preferably does not exceed 13.5 feet in height. Examples of suitable rigless deployment vehicles that may be employed as vehicle 30 are described in U.S. Pat. Nos. 6,273,188, and 7,182,140, each of which are hereby incorporated herein by reference in their entireties for all purposes.

As previously described, conduit 40 is used to deploy and position pump 100 downhole, as well provide a flow line or path for fluids pumped by pump 100 to the surface 11. A plurality of energy conductors or wires are provided in conduit 40 (e.g., embedded within the wall of conduit 40) or coupled to conduit 40 (e.g., coupled to the outside of conduit 40) for providing electrical power from the surface 11 to deliquification pump 100 to power pump and components thereof. In general, conduit 40 may comprise any suitable conduit capable of supplying electrical power to downhole pump 100 including, without limitation, coiled steel tubing, spoolable composite tubing, a cable with a flow bore, etc.

Figure 2:
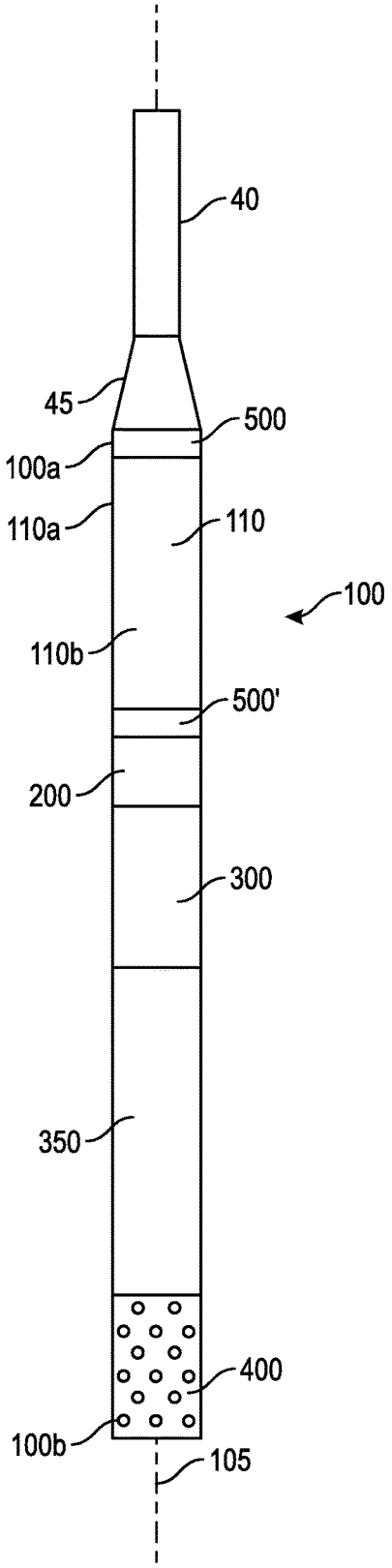
FIG. 2 is a schematic front view of the deliquification pump of FIG. 1.

Referring now to FIG. 2, deliquification pump 100 is hung from conduit 40 via connector 45 and has a central or longitudinal axis 105, a first or upper end 100*a* coupled to connector 45, and a second or lower end 100*b* distal to connector 45 and conduit 40. Moving axially from upper end 100*a* to lower end 100*b*, in this embodiment, pump 100 includes a fluid end pump 110, a hydraulic pump 200, an electric motor 300, a compensator 350, and a separator 400 coupled together end-to-end. Fluid end pump 110, hydraulic pump 200, motor 300, compensator 350, and separator 400 are coaxially aligned, each having a central axis coincident with pump axis 105.

Figure 3A:
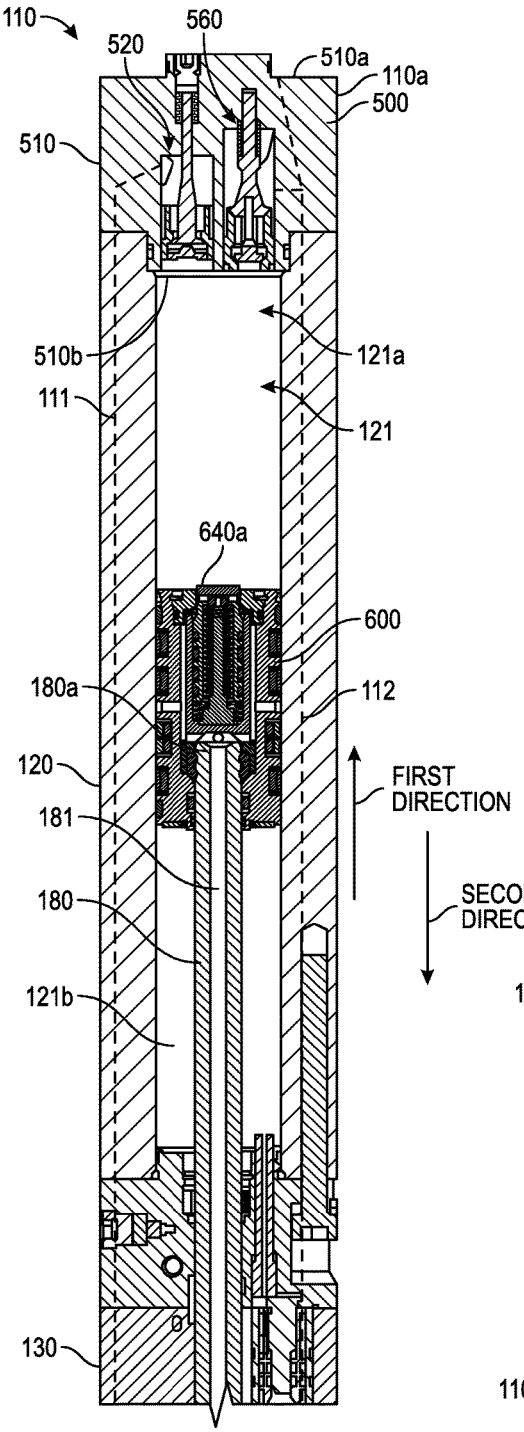
FIGS. 3A-3F are enlarged cross-sectional views of successive portions of the deliquification pump of FIG. 2.
Figure 3B:
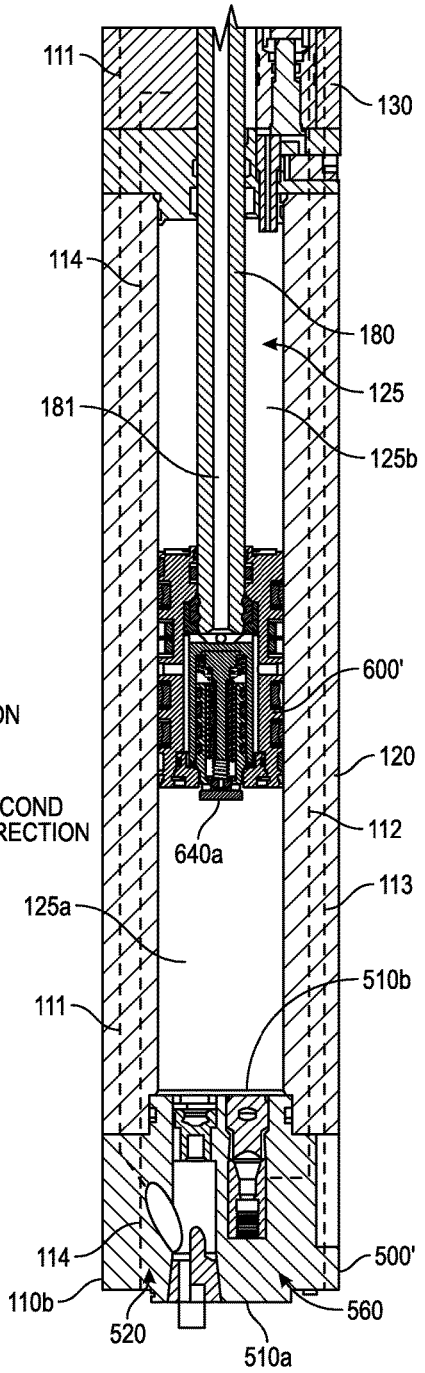
Figure 3C:
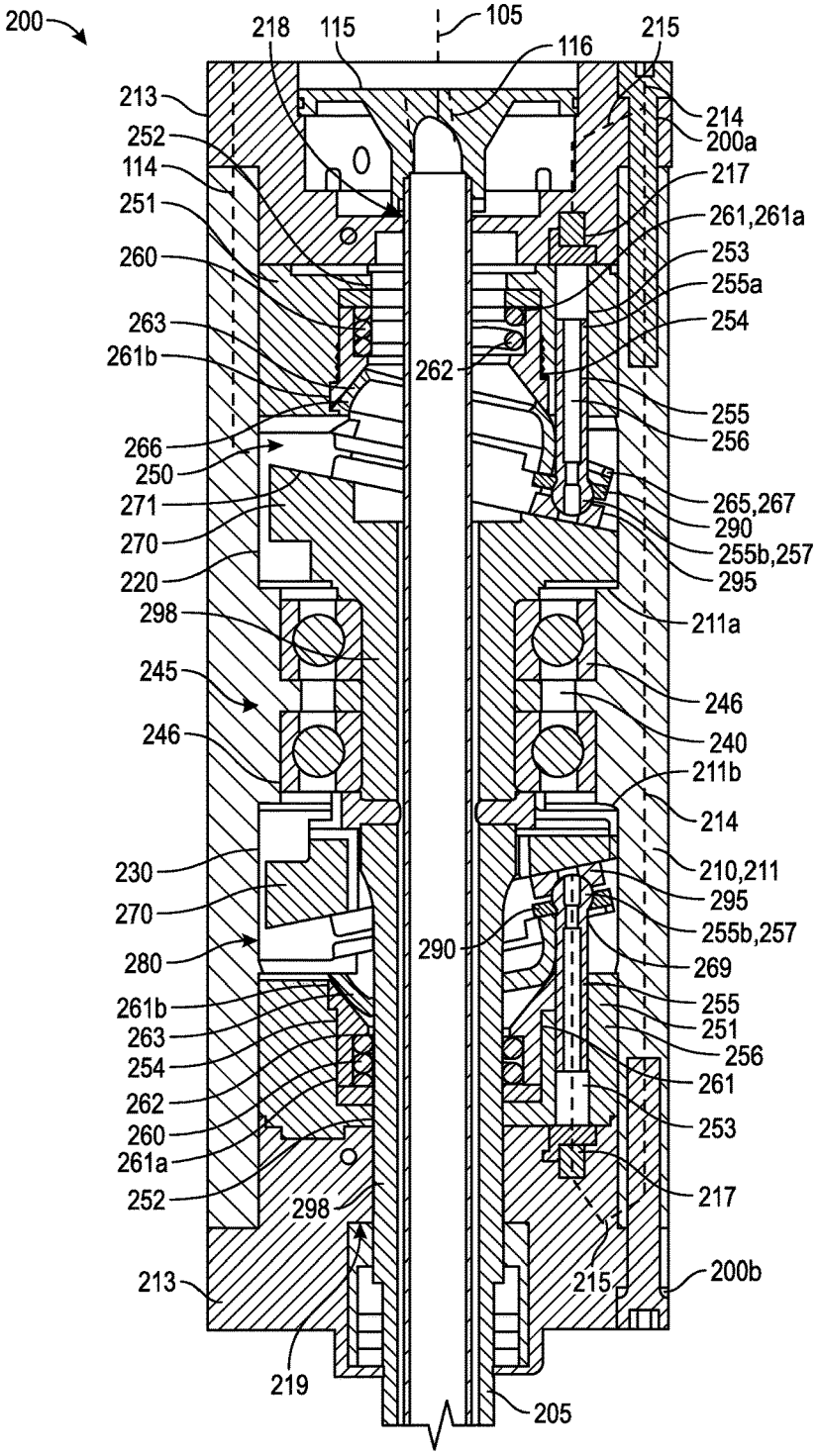
Figure 3D:
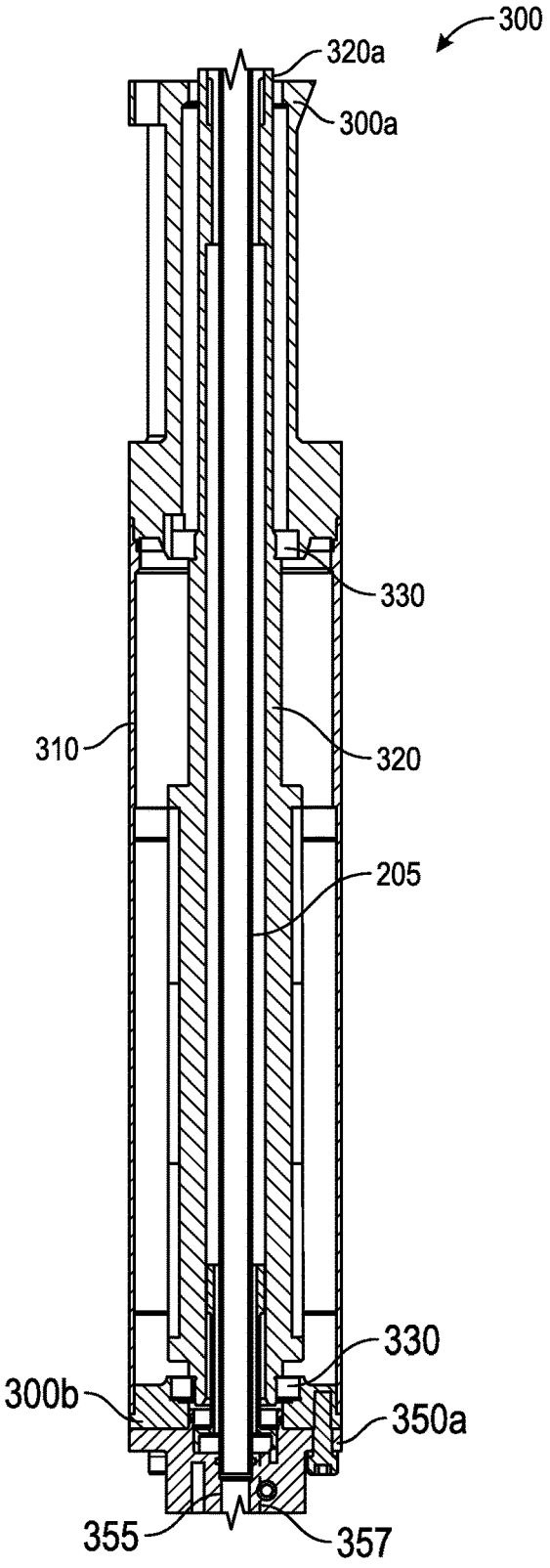
Figure 3E:
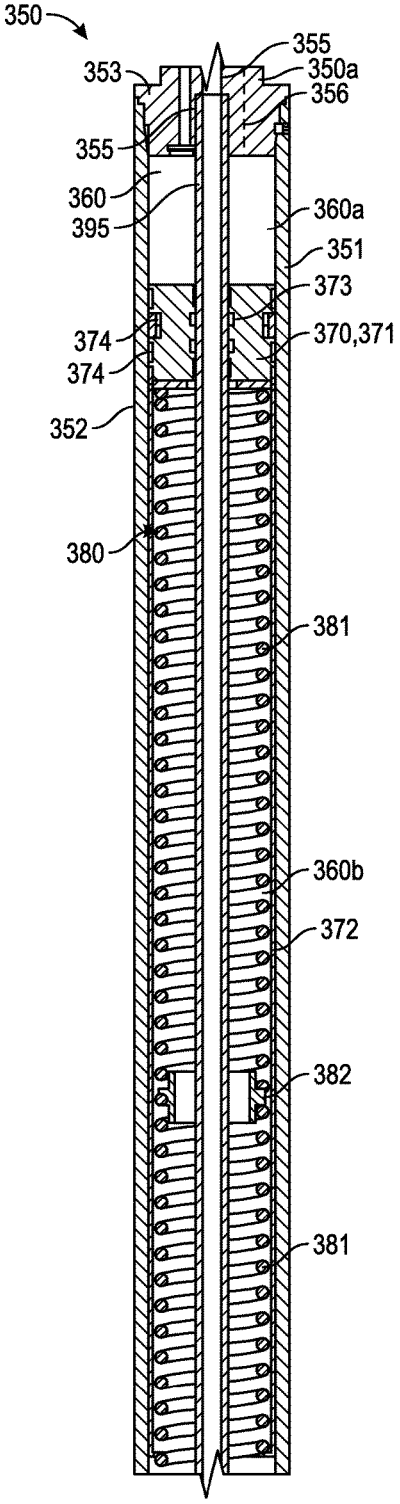
Figure 3F:
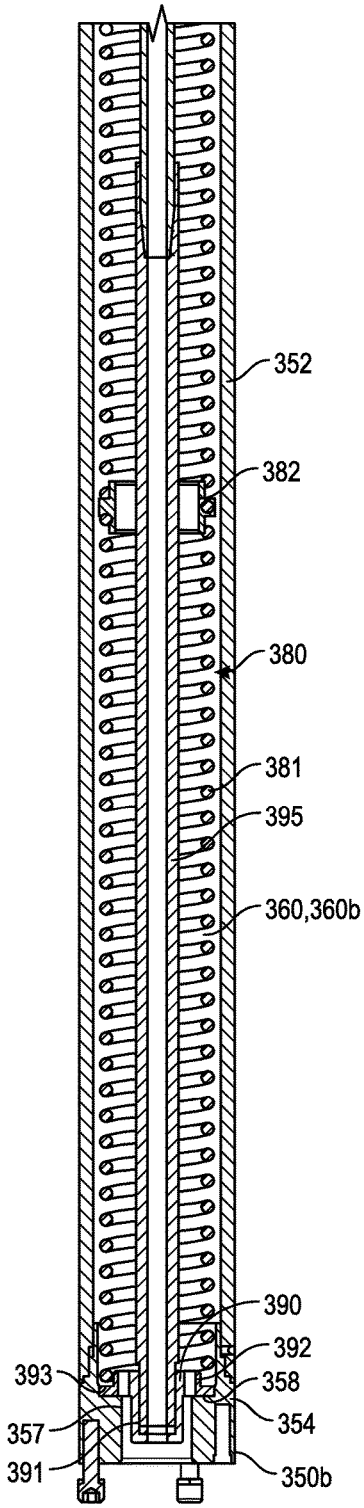

Due to the length of deliquification pump 100, it is illustrated in six longitudinally broken sectional views, vis-à-vis FIGS. 3A-3F. The sections are arranged in sequential order moving along pump 100 from FIG. 3A to FIG. 3F and are generally divided between the different components of pump 100. Namely, FIGS. 3A and 3B illustrate fluid end pump 110, FIG. 3C illustrates hydraulic pump 200, FIG. 3D illustrates electric motor 300, and FIGS. 3E and 3F illustrate compensator 350. In this embodiment, separator 400 is a filter including a screen to prevent large solids (e.g., sand, rock chips, etc.) from entering pump 100 along with well fluid 14, and thus, is not shown in a separate cross-sectional view.

Although FIG. 2 illustrates one exemplary order for stacking the components of deliquification pump 100 (i.e., fluid end pump 110 disposed above hydraulic pump 200, hydraulic pump 200 disposed above electric motor 300, electric motor 300 disposed a compensator 350, and compensator 350 disposed above separator 400), it should be appreciated that in other embodiments, the components of the deliquification pump (e.g., fluid end pump 110, hydraulic pump 200, electric motor 300, compensator 350, and separator 400 of deliquification pump 100) may be arranged in a different order. For example, the separator (e.g., separator 400) could be positioned at or proximal the upper end of the deliquification pump (e.g., at or near upper end 100*a* of pump 100).

Although components of deliquification pump 100 may be configured differently, the basic operation of pump 100 remains the same. In particular, well fluid 14 in wellbore 20 pass through separator 400, which separates larger solids (e.g., sand, rock chips, etc.) from well fluid 14 to form a solids-free or substantially solids-free fluid 15, which may also be referred to as "clean" fluid 15. Clean fluid 15 output from separator 400 is sucked into fluid end pump 110 and pumped to the surface 11 through coupling 45 and conduit 40. Fluid end pump 110 is driven by hydraulic pump 200, which is driven by electric motor 300. Conductors disposed in or coupled to conduit 40 provide electrical power downhole to motor 300. Compensator 350 provides a reservoir for hydraulic fluid, which can flow to and from hydraulic pump 200 and motor 300 as needed. Deliquification pump 100 is particularly designed to lift substantially solids-free fluid 15, which may include liquid and gaseous phases (e.g., water and gas), in wellbore 20 to the surface 11 in the event the gas pressure in wellbore 20 is insufficient to remove the liquids in fluid 14 to the surface 11 (i.e., wellbore 20 is a relatively low pressure well). As will be described in more detail below, use of hydraulic pump 200 in conjunction with fluid end pump 110 offers the potential to generate the relatively high fluid pressures necessary to force or eject relatively low volumes of well fluids 15 to the surface 11.

Referring now to FIGS. 3A and 3B, fluid end pump 110 is a double acting reciprocating pump having a first or upper end 110*a* and a second or lower end 110*b*. In particular, fluid end pump 110 includes a first or upper well fluids control valve assembly 500 at end 110*a*, a second or lower well fluids control valve assembly 500' disposed at end 110*b*, a radially outer pump housing 120 extending between valve assemblies 500, 500', a hydraulic fluid distribution system 130 axially positioned between valve assemblies 500, 500', a first or upper piston chamber 121 disposed within housing 120 and extending axially from valve assembly 500 to distribution system 130, and a second or lower piston chamber 125 disposed within housing 120 and extending axially from valve assembly 500' to distribution system 130. As will be described in more detail below, valve assemblies 500, 500' are substantially the same. In particular, each valve assembly 500, 500' includes a valve body 510, a well fluids inlet valve 520, and a well fluids outlet valve 560.

In this embodiment, housing 120 is formed from a plurality of tubular segments connected together end-to-end. Consequently, housing 120 is modular and may be broken down into various subcomponents as necessary for maintenance or repair (e.g., replacement of piston seals, etc.).

Fluid end pump 110 also includes a first or upper piston 600 slidingly disposed in first chamber 121 and a second or lower piston 600' slidingly disposed in second chamber 125. As will be described in more detail below, pistons 600, 600' are identical. Pistons 600, 600' are connected by an elongate connecting rod 180 that extends axially through distribution system 130.

Piston 600 divides upper chamber 121 into two sections or subchambers—a well fluids section 121 a extending axially from upper valve assembly 500 to piston 600, and a hydraulic fluid chamber 121*b* extending axially from piston 600 to distribution system 130. Likewise, piston 600' divides lower chamber 125 into two sections or subchambers—a well fluids section 125*a* extending axially from lower valve assembly 500' to piston 600', and a hydraulic fluid chamber 125*b* extending axially from piston 600' to distribution system 130. Together, housing 120, piston 600, and valve assembly 500 define section 121*a;* and together, housing 120, piston 600', and valve assembly 500' define section 125*a*. In general, inlet valve 520 of valve assembly 500, 500' controls the flow of well fluids 15 into chamber section 121*a*, 125*a*, respectively, and outlet valve 560 of valve assembly 500, 500' controls the flow of well fluids out of chamber section 121*a*, 125*a*, respectively.

Referring still to FIGS. 3A and 3B, a well fluids inlet conduit or passage 111, a well fluids outlet conduit or passage 112, a hydraulic fluid supply conduit or passage 113, and a hydraulic fluid return passage 114 extend through fluid end pump 110. Passages 111, 112, 113, 114 are not visible in the particular cross-section shown in FIGS. 3A and 3B, and thus, each passage 111, 112, 113, 114 is schematically represented by a dashed line in FIGS. 3A and 3B. In this embodiment, each passage 111, 112, 113, 114 extends through at least a portion of housing 120 and at least a portion of distribution system 130. Passages 111, 112, 113, 114 are circumferentially-spaced about axis 105.

Inlet passage 111 supplies well fluids that have been filtered by separator 400 to inlet valves 520, and outlet passage 112 supplies pressurized well fluids from outlet valves 560 to conduit 40. More specifically, substantially solids-free well fluids 15 are output from separator 400 and flow through a well fluids flow passage 116 in a distributor 115 coupled to lower valve assembly 500' and axially positioned between fluid end pump 110 and hydraulic pump 200 (FIG. 3C). Inlet valve 520 of lower valve assembly 500' is in fluid communication with well fluids flow passage 116. Thus, separator 400 supplies well fluids 15 to inlet valve 520 of lower valve assembly 500' via well fluids flow passage 116. In addition, inlet passage 111 extends between and is in fluid communication with inlet valve 520 of lower valve assembly 500' and inlet valve 520 of upper valve assembly 500. Thus, well fluids 15 from separator 400 flow through well fluids flow passage 116, inlet valve 520 of lower valve assembly 500', and inlet passage 111 to inlet valve 520 of upper valve assembly 500. In other words, well fluids flow passage 116 supplies well fluids 15 to inlet valve 520', and inlet passage 111 supplies well fluids 15 from well fluids flow passage 116 and inlet valve 520' to inlet valve 520.

Outlet passage 112 is in fluid communication with conduit 40 (via coupling 45), outlet valve 560 of upper valve assembly 500, and outlet valve of lower valve assembly 500'. Thus, outlet passage 112 places both outlet valves 560 in fluid communication with conduit 40. Outlet valves 560 of valve assemblies 500, 500' control the flow of well fluids out of chamber sections 121*a*, 125*a*, respectively. As will be described in more detail below, well fluids 15 are pumped by fluid end pump 110 from chamber sections 121*a*, 125*a* through outlet valves 560, outlet passage 112, and conduit 40 to the surface 11.

Referring still to FIGS. 3A and 3B, passage 113 supplies pressurized hydraulic fluid from hydraulic pump 200 to distribution system 130 and passage 114 returns hydraulic fluid from distribution system 130 to compensator 350. As will be described in more detail below, hydraulic fluid distribution system 130 includes a plurality of valves and associated flow passages that alternate the flow of the pressurized hydraulic fluid to hydraulic fluid chambers 121*b*, 125*b*, thereby driving the axial, reciprocal motion of pistons 600, 600'.

During pumping operations, hydraulic pump 200 provides pressurized hydraulic fluid to distribution system 130 via fluid passage 113. Distribution system 130 alternates the supply of pressurized hydraulic fluid between chambers 121*b*, 125*b* to drive the axial reciprocation of pistons 600, 600' in chambers 121, 125, respectively. In addition, distribution system 130 allows fluid to exit the section 125*b*, 121*b* that is not being supplied pressurized hydraulic fluid.

As distribution system 130 supplies pressurized hydraulic fluid to chamber 121*b*, piston 600 is urged axially in a first direction (upward in FIG. 3A) within chamber 121 towards valve assembly 500, thereby increasing the volume of section 121*b* and decreasing the volume of section 121*a*. Since pistons 600, 600' are connected by connecting rod 180, pistons 600, 600' move axially together. Thus, when piston 600 is moves axially in the first direction within chamber 121, piston 600' also moves axially in the first direction within chamber 125, thereby decreasing the volume of section 125*b* and increasing the volume of section 125*a*. Simultaneous with directing pressurized hydraulic fluid to chamber 121*b*, distribution system 130 allows hydraulic fluid to exit section 125*b*, thereby allowing the volume of section 125*b* to decrease without restricting the axial movement of pistons 600, 600'. The axial movement of pistons 600, 600' in the first direction continues as pressurized hydraulic fluid is supplied to chamber 121*b*. When piston 600 is at the axially outermost end of its stroke relative to distribution system 130 (i.e., piston 600 is at its furthest axial position from distribution system 130), the volume of section 121*a* is at its minimum, and piston 600' is at the axially innermost end of its stroke relative to distribution system 130 (i.e., piston 600' is at its closest axial position to distribution system 130). In this embodiment, fluid end pump 110 and upper valve assembly 500 are sized and configured to minimize the dead or unswept volume in section 121 a when piston 600 is at the outermost end of its stroke. In embodiments, described herein, the volume of section 121*a* when piston 600 is at the outermost end of its stroke (i.e., the unswept volume of section 121*a*) is close to zero.

Referring still to FIGS. 3A and 3B, simultaneous with piston 600 achieving the axially outermost end of its stroke (i.e., its closest axial position relative to upper valve assembly 500), distribution system 130 stops supplying pressurized hydraulic fluid to chamber 121*b*, and begins supplying pressurized hydraulic fluid to chamber 125*b*. As pressurized hydraulic fluid flows into chamber 125*b*, piston 600' is urged axially in the second direction (downward in FIG. 3B) within chamber 125 towards valve assembly 500', thereby increasing the volume of section 125*b* and decreasing the volume of section 125*a*. Since pistons 600, 600' are connected by connecting rod 180, as piston 600' moves axially in the second direction within chamber 125, piston 600 also moves axially in the second direction within chamber 121, thereby decreasing the volume of section 121*b* and increasing the volume of section 121*a*. Simultaneous with directing pressurized hydraulic fluid to chamber 125*b*, distribution system 130 allows hydraulic fluid to exit section 121*b*, thereby allowing the volume of section 121*b* to decrease without restricting the axial movement of pistons 600, 600'. The axial movement of pistons 600, 600' in the second direction continues as pressurized hydraulic fluid is supplied to chamber 125*b*. When piston 600' is at the axially outermost end of its stroke relative to distribution system 130 (i.e., piston 600' is at its furthest axial position from distribution system 130), the volume of section 125*a* is at its minimum, and piston 600 is at the axially innermost end of its stroke relative to distribution system 130 (i.e., piston 600 is at its closest axial position to distribution system 130). In this embodiment, fluid end pump 110 and lower valve assembly 500' are sized and configured to minimize the dead or unswept volume in section 125*a* when piston 600' is at the outermost end of its stroke. In embodiments, described herein, the volume of section 125*a* when piston 600' is at the outermost end of its stroke (i.e., the unswept volume of section 125*a*) is close to zero. Simultaneous with piston 600' achieving the axially outermost end of its stroke (i.e., its closest position to upper valve assembly 500), distribution system 130 stops supplying pressurized hydraulic fluid to chamber 125*b*, begins supplying pressurized hydraulic fluid to chamber 121*b*, and the process repeats. In the manner previously described, pistons 600, 600' are axially reciprocated within chambers 121, 125 by reciprocating the flow of pressurized hydraulic fluid into sections 121*b*, 125*b*.

As previously described, as pistons 600, 600' move axially in the first direction (upward in FIGS. 3A and 3B) within chambers 121, 125, respectively, the volume of section 121*a* decreases, and the volume of section 125*a* increases. As the volume of section 121*a* decreases, the pressure of well fluids 15 therein increases, and as the volume of section 125*a* increases, the pressure of well fluids 15 therein decreases. When the pressure in section 121*a* is sufficiently high, outlet valve 560 of upper valve assembly 500 transitions to an "open position," thereby allowing well fluids to flow from section 121*a* into conduit 40 via outlet passage 112 and coupling 45; and when the pressure in section 125*a* is sufficiently low, inlet valve 520 of lower valve assembly 500' transitions to an "open position," thereby allowing well fluids to flow into section 125*a* from well fluids flow passage 116. As will be described in more detail below, each valve assembly 500, 500' is designed such that outlet valve 560 is closed when its corresponding inlet valve 520 is open, and inlet valve 520 is closed when its corresponding outlet valve 560 is open. Conversely, as pistons 600, 600' move axially in the second direction (downward in FIGS. 3A and 3B) within chambers 121, 125, respectively, the volume of section 121*a* increases, and the volume of section 125*a* decreases. As the volume of section 121*a* increases, the pressure of well fluids 15 therein decreases, and as the volume of section 125*a* decreases, the pressure of well fluids 15 therein increases. When the pressure in section 121*a* is sufficiently low, inlet valve 520 of upper valve assembly 500 transitions to an "open position," thereby allowing well fluids to flow into section 121*a* from inlet passage 111; and when the pressure in section 125*a* is sufficiently high, outlet valve 560 of lower valve assembly 500' transitions to an "open position," thereby allowing well fluids to flow from section 125*a* to conduit 40 via outlet passage 112 and coupling 45.

As pistons 600, 600' reciprocate within chambers 121, 125, well fluids 15 are sucked into sections 121*a*, 125*a* from well fluids flow passage 116 and inlet passage 111, respectively, in an alternating fashion, and pumped from sections 125*a*, 121*a*, respectively, to outlet passage 112 and conduit 40 in an alternating fashion. In this manner, fluid end pump 110 pumps well fluids 15 through conduit 40 to the surface 11. Since fluid end pump 110 is a double acting reciprocating pump, well fluids 15 are pumped from fluid end pump 110 to the surface 11 when pistons 600, 600' move axially in either direction (the first direction or the second direction), and well fluids 15 are sucked from separator 400 into fluid end pump 110 when pistons 600, 600' move axially in either direction (the first direction or the second direction).

Figure 4A:
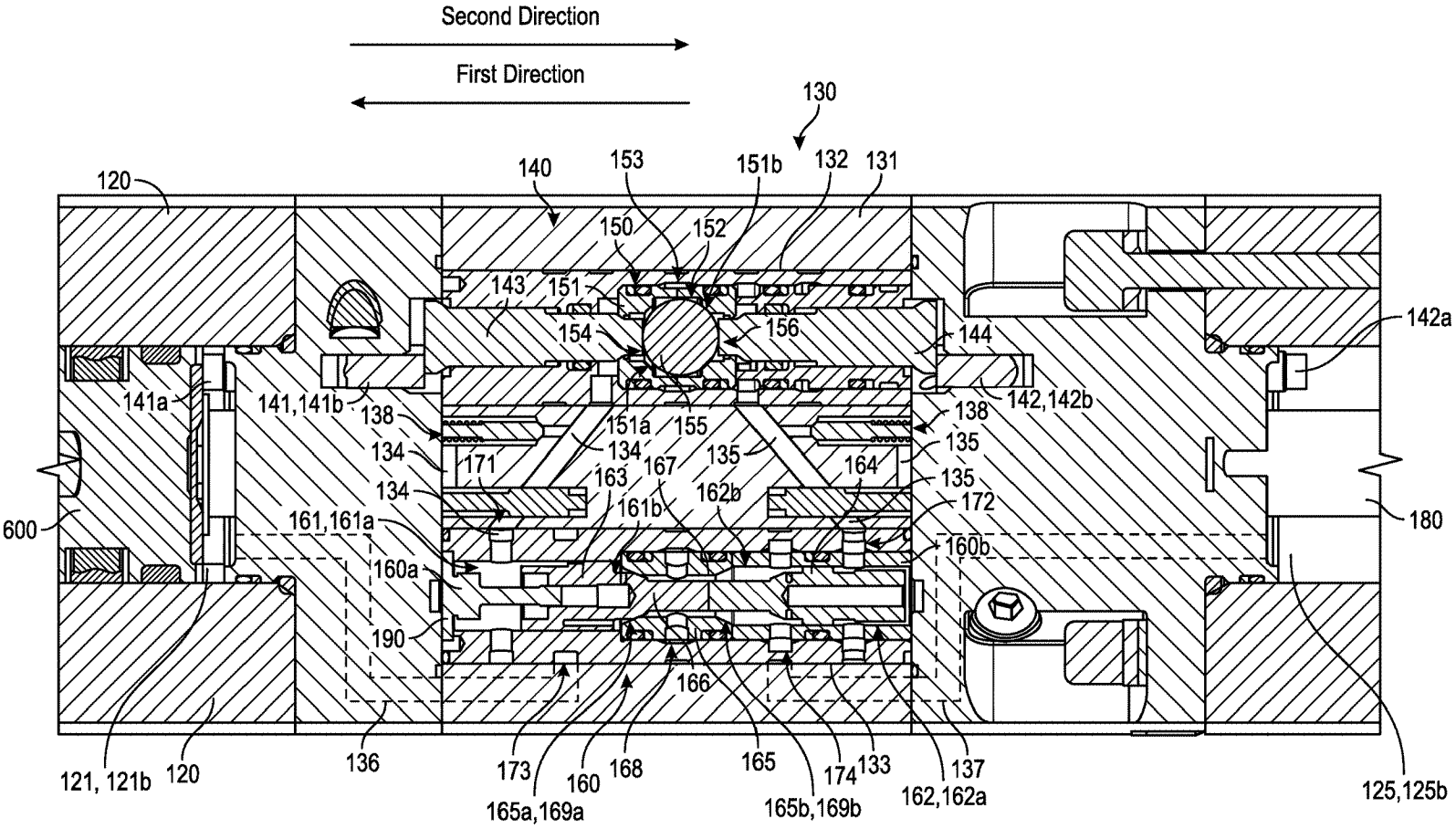
FIGS. 4A and 4B are enlarged cross-sectional view of the shuttle valve assembly of FIGS. 3A and 3B.
Figure 4B:
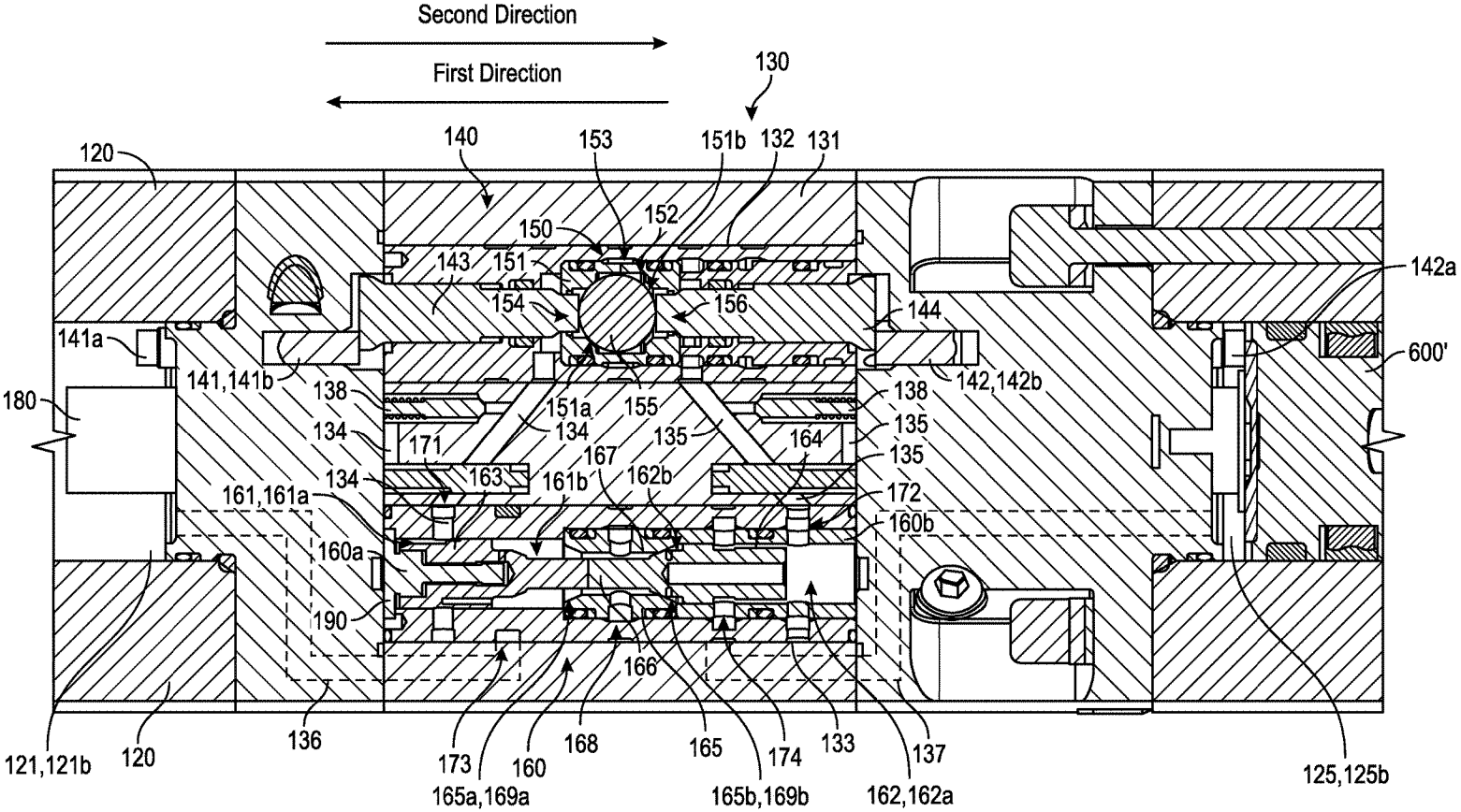

Referring now to FIGS. 4A and 4B, hydraulic fluid distribution system 130 of fluid end pump 110 is shown. Assembly 130 includes a body 131 forming part of housing 120, a mechanical switch 140 disposed in body 131, and a shuttle valve 160 disposed in body 131. Body 131 includes a first inner chamber 132, a second inner chamber 133, and a plurality of hydraulic fluid passages 134, 135, 136, 137. First hydraulic fluid passage 134 extends from chamber 132 to chamber 133 and second hydraulic fluid passage 135 extends from chamber 132 to chamber 133. A check valve 138 is disposed in each passage 134, 135 to ensure one-way flow of hydraulic fluid through each passage 134, 135 from chamber 132 to chamber 133. Third hydraulic fluid passage 136 extends from chamber 133 to section 121*b* of piston chamber 121 and fourth hydraulic fluid passage 137 extends from chamber 133 to section 125*b* of piston chamber 125. Hydraulic fluid supply passage 113 extends through body 131 to chamber 132, and hydraulic fluid return passage 114 extends through body 131 to chamber 133. Passages 113, 114 are not visible in the particular cross-section shown in FIGS. 4A and 4B.

Mechanical switch 140 is seated in chamber 132, and includes a first pushrod 141, a second pushrod 142, a first actuation pin 143, a second actuation pin 144, and a hydraulic fluid valve 150. Pins 143, 144 are axially positioned between pushrods 141, 142, and valve 150 is axially positioned between pins 143, 144. First pushrod 141 extends axially through body 131 and has a first end 141*a* disposed in section 121*b* of chamber 121 and a second end 141*b* axially adjacent first actuation pin 143. Second pushrod 142 extends axially through body 131 and has a first end 142*a* disposed in section 125*b* of chamber 125 and a second end 142*b* axially adjacent second actuation pin 144. Each pin 143, 144 has a first end axially adjacent end 141*b*, 142*b*, respectively, and a second end extending into valve 150. As will be described in more detail below, pushrods 141, 142 and pins 143, 144 reciprocate axially relative to body 131.

Valve 150 includes a valve cage 151 and a ball 155. Valve cage 151 has an inner cavity 152, a hydraulic fluid inlet port 153, a first hydraulic fluid outlet port 154, and a second hydraulic fluid outlet port 156. Inlet port 153 is in fluid communication with cavity 152 and hydraulic fluid supply passage 113, and thus, allows fluid communication therebetween. Outlet port 154 is in fluid communication with cavity 152 and first hydraulic fluid passage 134, and outlet port 156 is in fluid communication with cavity 152 and second hydraulic fluid passage 135. One end of each pin 143, 144 extends axially into port 153, 154, respectively, axially adjacent ball 155. However, pins 143, 144 do not block fluid flow through ports 153, 154. As will be described in more detail below, ball 155 axially reciprocates within cavity 152 in response to the axial reciprocation of pins 143, 144.

Cage 151 includes a first annular valve seat 151 a at the intersection of port 154 and cavity 152 and a second annular valve seat 151*b* at the intersection of port 156 and cavity 152. Ball 155 reciprocates axially into and out of sealing engagement with seats 151*a*, 151*b*. Seats 151*a*, 151*b* are axially spaced such that when ball 155 engages seat 151*a* (FIG. 4B), ball 155 is disengaged from seat 151*b*; and when ball 155 engages seat 151*b* (FIG. 4A), ball 155 is disengaged from seat 151*a*. Moreover, when ball 155 engages seat 151*a* (FIG. 4B), ball 155 prevents hydraulic fluid from flowing from cavity 152 into outlet port 154, however, hydraulic fluid is free to flow from supply passage 113 through inlet port 153, cavity 152 (around ball 155), and outlet port 156 (between pin 144 and cage 151) into passage 135; and when ball 155 engages seat 151*b* (FIG. 4A), ball 155 prevents hydraulic fluid from flowing into outlet port 156, however, hydraulic fluid is free to flow from supply passage 113 through inlet port 153, cavity 152 (around ball 155), and outlet port 154 (between pin 143 and cage 151) into passage 134.

Referring still to FIGS. 4A and 4B, shuttle valve 160 is seated in chamber 133 and has a first closed end 160*a* and a second closed end 160*b* opposite end 160*a*. In addition, shuttle valve 160 includes a first inner chamber 161, a second inner chamber 162, a first piston 163 slidingly disposed in chamber 161, a second piston 164 slidingly disposed in chamber 162, and an annular hydraulic fluid flow diverter 165 axially positioned between chambers 161, 162 and corresponding pistons 163, 164. First inner chamber 161 extends axially from end 160*a* to diverter 165, and second inner chamber 162 extends axially from end 160*b* to diverter 165. First piston 163 divides first chamber 161 into a first section 161*a* extending axially from end 160*a* to piston 163 and a second section 161*b* extending axially from diverter 165 to piston 163. Second piston 164 divides second chamber 162 into a first section 162*a* extending axially from end 160*b* to piston 164 and a second section 162*b* extending axially from diverter 165 to piston 164. Pistons 163, 164 are connected with a connection rod 166 and reciprocate axially within chambers 161, 162, respectively. As pistons 163, 164 reciprocate, the relative volumes of sections 161*a*, 161*b*, 162*a*, 162*b* change.

Shuttle valve 160 also includes a first hydraulic fluid inlet port 171, a second hydraulic fluid inlet port 172, a hydraulic fluid inlet-outlet port 173, and a hydraulic fluid inlet-outlet port 174. Inlet port 171 extends between passage 134 and first chamber 161, second inlet port 172 extends between passage 135 and second chamber 162, first port 173 extends from first chamber 161 to passage 136, and second port 174 extends from second chamber 162 to passage 137. Passage 134 and first section 161 a of chamber 161 are always in fluid communication via inlet port 171, and passage 135 and first section 162*a* of chamber 162 are always in fluid communication via inlet port 172. However, pistons 163, 164 selectively control fluid communication between sections 161*a*, 162*a* and passages 136, 137, respectively, via ports 173, 174 respectively.

Diverter 165 is axially positioned between chambers 161, 162 and corresponding pistons 163, 164. Diverter 165 has a first end 165*a* facing chamber 161, a second end 165*b* facing chamber 162, a throughbore 167 extending axially between ends 165*a*, 165*b*, and a hydraulic fluid return port 168 in fluid communication with throughbore 167 and hydraulic fluid return passage 114. A first annular valve seat 169*a* is disposed about throughbore 167 at end 165*a* and a second annular valve seat 169*b* is disposed about throughbore 167 at end 165*b*. Connection rod 166 extends axially through throughbore 167, but does not engage diverter 165. Namely, rod 166 has an outer diameter that is less than the diameter of throughbore 167. Thus, rod 166 does not prevent fluid communication between throughbore 167 and port 168.

Pistons 163, 164 reciprocate axially into and out of sealing engagement with seats 169*a*, 169*b*, respectively. Rod 166 has an axial length greater than the axial length of diverter 165. Thus, when piston 163 sealingly engages seat 169*a*, piston 164 is axially spaced from seat 169*b*; and when piston 164 sealingly engages seat 169*b*, piston 163 is axially spaced from seat 169*a*.

When piston 163 engages seat 169*a* as shown in FIG. 4A: (a) the volumes of sections 161*a*, 162*b* are at their maximums; (b) the volumes of sections 161*b*, 162*a* are at their minimums; (c) passages 134, 136 are in fluid communication via first section 161*a* of chamber 161 and port 173; (d) sections 161*a*, 161*b* are not in fluid communication with throughbore 167, port 168, or return passage 114; (e) passage 135 and section 162*a* are not in fluid communication with port 174 or passage 137; and (f) passage 137 is in fluid communication with port 174, section 162*b*, throughbore 167, port 168, and return passage 114. On the other hand, when piston 164 engages seat 169*b* as shown in FIG. 4B: (a) the volumes of sections 161*b*, 162*a* are at their maximums; (b) the volumes of section 161*a*, 162*b* are at their minimums; (c) passages 135, 137 are in fluid communication via first section 162*a* of chamber 162 and port 174; (d) sections 162*a*, 162*b* are not in fluid communication with throughbore 167, port 168, or return passage 114; (e) passage 134 and section 161*a* are not in fluid communication with port 173 or passage 136; and (f) passage 136 is in fluid communication with port 173, section 161*b*, throughbore 167, port 168, and return passage 114.

As previously described, distribution system 130 alternates the supply of pressurized hydraulic fluid from hydraulic pump 200 between sections 121*b*, 125*b* of fluid end pump 110 to axially reciprocate pistons 600, 600' and pump well fluids to the surface via tubing 40. Referring first to FIG. 4A, during pumping operations, pistons 600, 600' moves axially in the second direction (to the right in FIG. 4A and downward in FIGS. 3A and 3B) until piston 600 axially impacts pushrod 141, thereby pushing pushrod 141 and pin 143 axially in the second direction. Pin 143 contacts ball 155 and moves ball 155 into sealing engagement with seat 151*b*. Pressurized hydraulic fluid is continuously supplied to cavity 152 via hydraulic fluid supply passage 113 and inlet port 153. Thus, when ball 155 engages seat 151*b*, the pressurized hydraulic fluid in cavity 152 flows through outlet port 154, passage 134, and inlet port 171 into section 161*a* of first chamber 161. In addition, engagement of ball 155 and seat 151*b* prevents the pressurized hydraulic fluid in cavity 152 from flowing through outlet port 156 into passage 135 into section 162*a* of chamber 162. The pressurized hydraulic fluid in section 161*a* pushes piston 163 in the second direction and into sealing engagement with seat 169*a*, thereby moving piston 164 out of sealing engagement with seat 169*b*. As a result, pressurized hydraulic fluid in section 161*a* flows through port 173 and passage 136 into section 121*b* of piston chamber 121. The pressure applied to piston 600 by the pressurized hydraulic fluid flowing into section 121*b* moves piston 600 axially in a first direction (to the left in FIG. 4A and upward in FIGS. 3A and 3B), which simultaneously causes piston 600' to move in the first direction since pistons 600, 600' are linked by connecting rod 180. The pressure applied to ball 155 by the pressurized hydraulic fluid flowing through cavity 152 and outlet port 154 maintains ball 155 in engagement with seat 151*b* as piston 600 moves axially away from end 141*a* of pushrod 141. In addition, the pressure applied to piston 163 by the pressurized hydraulic fluid flowing through section 161*a* into passage 136 maintains piston 163 in engagement with seat 169*a*, thereby allowing pressurized hydraulic fluid to continue to flow into section 121*b* of piston chamber 121 and move piston 600 in the first direction.

As pistons 600, 600' move in the first direction, the volume of section 121*b* increases (as it fills with pressurized hydraulic fluid), and the volume of section 125*b* decreases. However, as the volume of section 125*b* decreases, the hydraulic fluid in section 125*b* flows through passage 137, port 174, section 162*b*, throughbore 167, port 168 and return passage 114 to compensator 350, thereby avoiding hydraulic lock of pistons 600, 600' and allowing pistons 600, 600' continue to move axially in the first direction until piston 600' axially impacts end 142*b* of pushrod 142.

Referring now to FIG. 4B, when piston 600' is moving in the first direction and axially impacts pushrod 142, it pushes pushrod 142 and pin 144 axially in the first direction. Pin 144 contacts ball 155, and moves ball 155 out of sealing engagement with seat 151*b* and into sealing engagement with seat 151*a*. In particular, the axial force exerted on ball 155 by pin 144 exceeds the force generated by the pressure applied to ball 155 by the pressurized hydraulic fluid flowing through cavity 152 and outlet port 154. As previously described, pressurized hydraulic fluid is continuously supplied to cavity 152 via hydraulic fluid supply passage 113 and inlet port 153. Thus, when ball 155 engages seat 151*a*, the pressurized hydraulic fluid in cavity 152 flows through outlet port 156, passage 135, and inlet port 172 into section 162*a* of chamber 162; engagement of ball 155 and seat 151*a* prevents the pressurized hydraulic fluid in cavity 152 from flowing through outlet port 154 into passage 134 and section 161*a*. The pressurized hydraulic fluid in section 162*a* moves piston 164 in the first direction into sealing engagement with seat 169*b*, which moves piston 163 out of sealing engagement with seat 169*a*. As a result, pressurized hydraulic fluid in section 162*a* flows through port 174 and passage 137 into section 125*b* of piston chamber 125. The pressure applied to piston 600' by pressurized hydraulic fluid in section 125*b* moves piston 600' axially in the second direction (to the right in FIG. 4B and upward in FIGS. 3A and 3B), which simultaneously causes piston 600 to move in the second direction since pistons 600, 600' are linked by connecting rod 180. The pressure applied to ball 155 by the pressurized hydraulic fluid flowing through cavity 152 and outlet port 156 maintains ball 155 in engagement with seat 151*a* as piston 600' moves axially away from end 142*b* of pushrod 142. In addition, the pressure applied to piston 164 by the pressurized hydraulic fluid flowing through section 162*a* into passage 137 maintains piston 164 in engagement with seat 169*b*, thereby allowing pressurized hydraulic fluid to continue to flow into section 125*b* of piston chamber 125 and move piston 600' in the second direction.

As pistons 600, 600' move in the second direction, the volume of section 125*b* increases (as it fills with pressurized hydraulic fluid), and the volume of section 121*b* decreases. However, as the volume of section 121*b* decreases, the hydraulic fluid in section 121*b* flows through passage 136, port 173, section 161*b* of chamber 161, throughbore 167, port 168 and return passage 114 to compensator 350, thereby avoiding hydraulic lock of pistons 600, 600'. Pistons 600, 600' continue to move axially in the second direction until piston 600 axially impacts pushrod 141 and the process repeats as previously described.

As previously described, ball 155 is moved axially between seats 151*a*, 151*b* by pins 143, 144. When ball 155 engages seat 151*b*, the pressurized hydraulic fluid in cavity 152 is supplied to section 161*a* of chamber 161, and when ball 155 engages seat 151*a*, the pressurized hydraulic fluid in cavity is supplied to section 162*a* of chamber 162. However, during the relatively short period of time when ball 155 is moving between seats 151*a*, 151*b*, pressurized hydraulic fluid in cavity 152 is provided to both sections 161*a*, 162*a*. This may result in the premature actuation of shuttle valve 160, which can negatively affect the operation of distribution system 130. Therefore, it is generally preferred that pistons 163, 164 do not move in the first direction until ball 155 is fully seated against seat 151 a, and further, that pistons 163, 164 do not move in the second direction until ball 155 is fully seated against seat 151*b*. Accordingly, in this embodiment, a calibration member 190 is provided in shuttle valve 160 to prevent pistons 163, 164 from moving in the first direction before ball 155 is fully seated against seat 151*a*, and prevent pistons 163, 164 from moving in the second direction until ball 155 is fully seated against seat 151*b*. As will be described in more detail below, calibration member 190 varies the cross-sectional area of piston 163 exposed to pressurized hydraulic fluid in section 161*a* to prevent the premature actuation of shuttle valve 160.

Figure 11A:
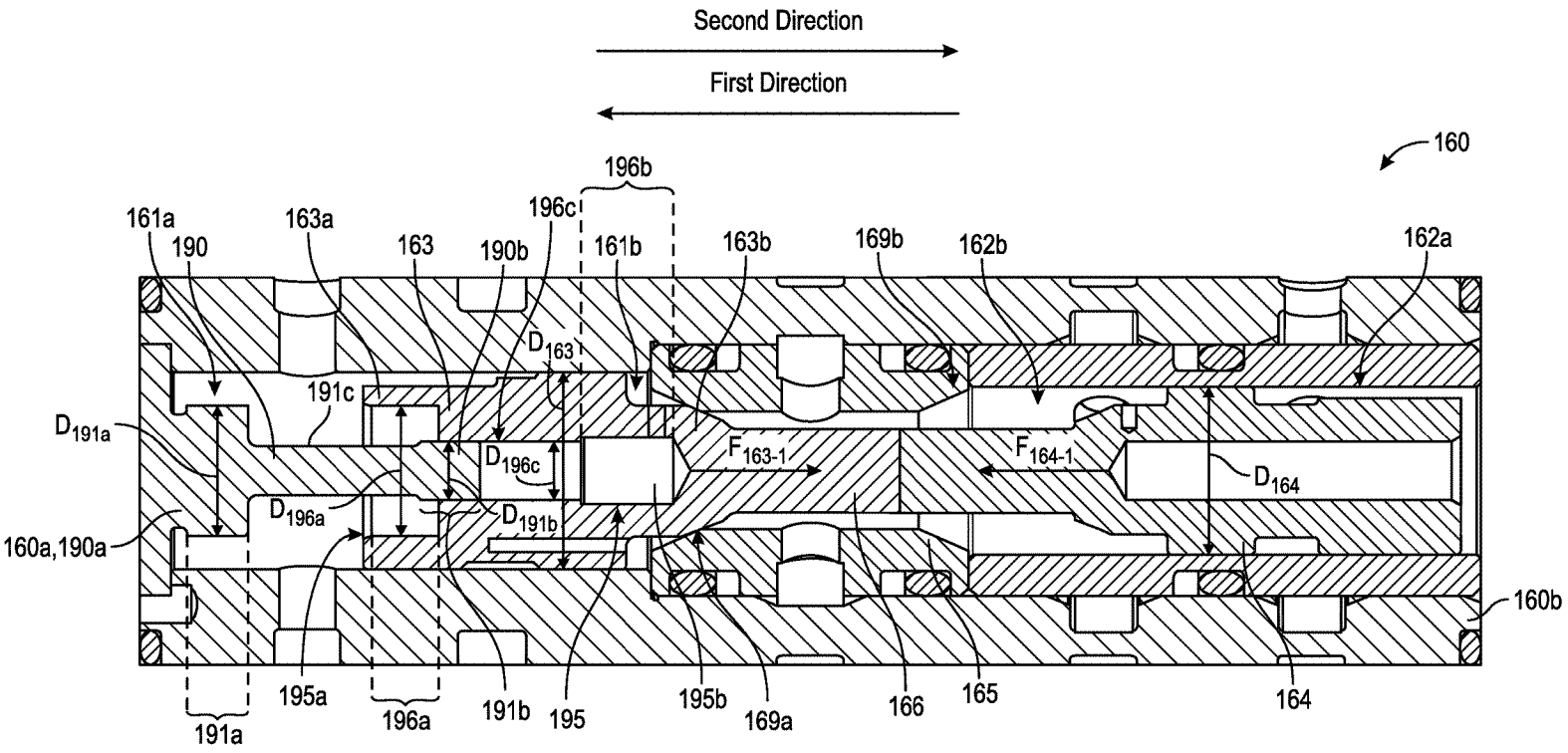
FIGS. 11A and 11B are enlarged views of the shuttle valve of FIGS. 4A and 4B, respectively.
Figure 11B:
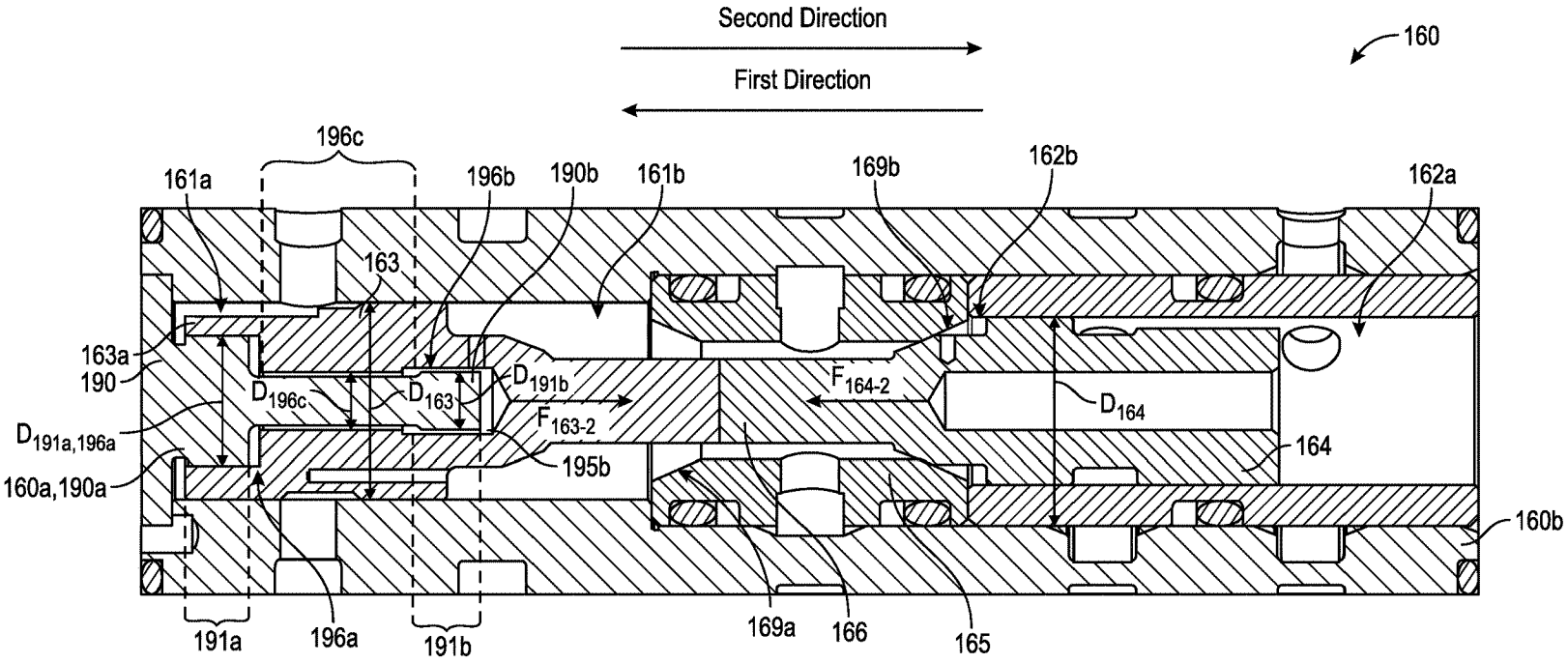

Referring now to FIGS. 11A and 11B, calibration member 190 extends axially from end 160*a* through section 161*a* of chamber 161 into a mating recess or counterbore 195 in piston 163. More specifically, calibration member 190 has a first end 190*a* at end 160*a* and a second end 190*b* disposed in counterbore 195 of piston 163. In addition, calibration member 190 includes a first cylindrical axial section or segment 191 a extending axially from end 190*a*, a second cylindrical axial section or segment 191*b* at end 190*b*, and a third cylindrical axial section or segment 191*c* extending axially between segments 191*a*, 191*b*. Segment 191*a* has an outer diameter $D_{191a}$ and segment 191*b* has an outer diameter $D_{191b}$ that is less than $D_{191a}$. The outer diameter of segment 191*c* is less than both outer diameters $D_{191a}$, $D_{191b}$.

Referring still to FIGS. 11A and 11B, piston 163 has a first or free end 163*a* distal rod 166 and a second end 163*b* integral with rod 166. Counterbore 195 extends axially from end 163*a* of piston 163. In particular, counterbore 195 has a first end 195*a* at end 163*a* of piston 163 and a second end 196*b* distal end 163*a* of piston 163. In addition, counterbore 195 includes a first axial section or segment 196*a* extending axially from end 195*a*, a second axial section or segment 196*b* extending axially from end 195*b*, and a third axial section or segment 196*c* extending axially between segments 196*a*, 196*b*. Segment 196*a* has a diameter $D_{196a}$ and segment 196*c* has a diameter $D_{196c}$ that is less than diameter $D_{196a}$. Segment 196*b* has an outer diameter that is between diameters $D_{196a}$, $D_{196c}$. Segment 191*a* of calibration member 190 slidingly engages segment 196*a* of counterbore 195, and segment 191*b* of calibration member 190 slidingly engages piston 163 along segment 196*c* of counterbore 195. Thus, diameter $D_{191a}$ is substantially the same as diameter $D_{196a}$, and diameter $D_{191b}$ is substantially the same as diameter $D_{196c}$.

In FIG. 11A, shuttle valve 160 is shown in a first position with piston 163 in sealing engagement with seat 169*a*, as is the case when ball 155 seated against seat 151*b* and pressurized hydraulic fluid is supplied to section 161 a (FIG. 4A); and in FIG. 11B, shuttle valve 160 is shown in a second position with piston 164 in sealing engagement with seat 169*b*, as is the case when ball 155 seated against seat 151*a* and pressurized hydraulic fluid is supplied to section 162*a* (FIG. 4B). Each piston 163, 164 has a maximum outer diameter $D_{163}$, $D_{164}$, respectively.

Referring again to FIG. 11A, when shuttle valve 160 is in the first position—the axial force $F_{163-1}$ acting on piston 163 by hydraulic fluid in section 161*a* is equal to the pressure of the hydraulic fluid in section 161*a* times the surface area $A_{163-1}$ of piston 163 facing section 161*a* and oriented normal to the axial direction (i.e., normal to axial force $F_{163-1}$), and the axial force $F_{164-1}$ acting on piston 164 by hydraulic fluid in section 162*a* is equal to the pressure of the hydraulic fluid in section 162*a* times the surface area $A_{164-1}$ of piston 164 facing section 162*a* and oriented normal to the axial direction (i.e., normal to axial force $F_{164-1}$). It should be appreciated that axial force $F_{163-1}$ seeks to maintain shuttle valve 160 in the first position (FIG. 11A) with piston 163 engaging seat 169*a*, whereas axial force $F_{164-1}$ seeks to transition shuttle valve 160 to the second position (FIG. 11B) with piston 164 engaging seat 169*b*. The surface areas $A_{163-1}$, $A_{164-1}$ are calculated as follows:

$$A_{163-1} = \pi \cdot \left( \left( \frac{D_{163}}{2} \right)^2 - \left( \frac{D_{196c}}{2} \right)^2 \right)$$

$$A_{164-1} = \pi \cdot \left( \frac{D_{164}}{2} \right)^2$$

In this embodiment, calibration member 190 and pistons 163, 164 are sized such that surface area $A_{163-1}$ is greater than surface area $A_{164-1}$. As a result, with shuttle valve 160 in the first position shown in FIG. 11A and pressurized hydraulic fluid supplied to both sections 161*a*, 162*a* as ball 155 is transitioned from seat 151*b* to seat 151*a*, axial force $F_{163-1}$ is greater than axial force $F_{164-1}$ (since the pressure of the hydraulic fluid in both sections 161*a*, 162*a* is the same and surface area $A_{163-1}$ is greater than surface area $A_{164-1}$), thereby maintaining shuttle valve 160 in the first position. Thus, the difference in surface areas $A_{163-1}$, $A_{164-1}$, enabled by calibration member 190, facilitates the maintenance of shuttle valve 160 in the first position as ball 155 moves from seat 151*b* to seat 151 a and prevents the premature actuation of shuttle valve 160.

As shown in FIG. 11 B, when shuttle valve 160 is in the second position—the axial force $F_{163-2}$ acting on piston 163 by hydraulic fluid in section 161*a* is equal to the pressure of the hydraulic fluid in section 161 a times the surface area $A_{163-2}$ of piston 163 facing section 161*a* and oriented normal to the axial direction (i.e., normal to axial force $F_{163-2}$), and the axial force $F_{164-2}$ acting on piston 164 by hydraulic fluid in section 162*a* is equal to the pressure of the hydraulic fluid in section 162*a* times the surface area $A_{164-2}$ of piston 164 facing section 162*a* and oriented normal to the axial direction (i.e., normal to axial force $F_{164-2}$). It should be appreciated that axial force $F_{162-2}$ seeks to maintain shuttle valve 160 in the second position (FIG. 11B) with piston 164 engaging seat 169*b*, whereas axial force $F_{163-2}$ seeks to transition shuttle valve 160 to the first position (FIG. 11A) with piston 163 engaging seat 169*a*. The surface areas $A_{163-2}$, $A_{162-2}$ are calculated as follows:

$$A_{163-2} = \pi \cdot \left( \left( \frac{D_{163}}{2} \right)^2 - \left( \frac{D_{196a}}{2} \right)^2 \right)$$

$$A_{164-2} = \pi \cdot \left( \frac{D_{164}}{2} \right)^2$$

Thus, area $A_{164-2}$ is the same as area $A_{164-1}$, however, area $A_{163-2}$ is less than area $A_{163-1}$ because diameter $D_{191b}$ is greater than diameter $D_{191a}$. In this embodiment, calibration member 190 and pistons 163, 164 are sized such that area $A_{163-2}$ is less than area $A_{164-2}$. As a result, with shuttle valve 160 in the second position shown in FIG. 11B and pressurized hydraulic fluid supplied to both sections 161*a*, 162*a* as ball 155 is transitioned from seat 151 a to seat 151*b*, axial force $F_{163-2}$ is less than axial force $F_{164-2}$ (since the pressure of the hydraulic fluid in both sections 161*a*, 162*a* is the same and surface area $A_{163-2}$ is less than surface area $A_{164-2}$), thereby maintaining shuttle valve 160 in the second position. Thus, the difference in surface areas $A_{163-2}$, $A_{164-2}$, enabled by calibration member 190, facilitates the maintenance of shuttle valve 160 in the second position as ball 155 moves from seat 151*a* to seat 151*b* and prevents the premature actuation of shuttle valve 160.

Figure 5:
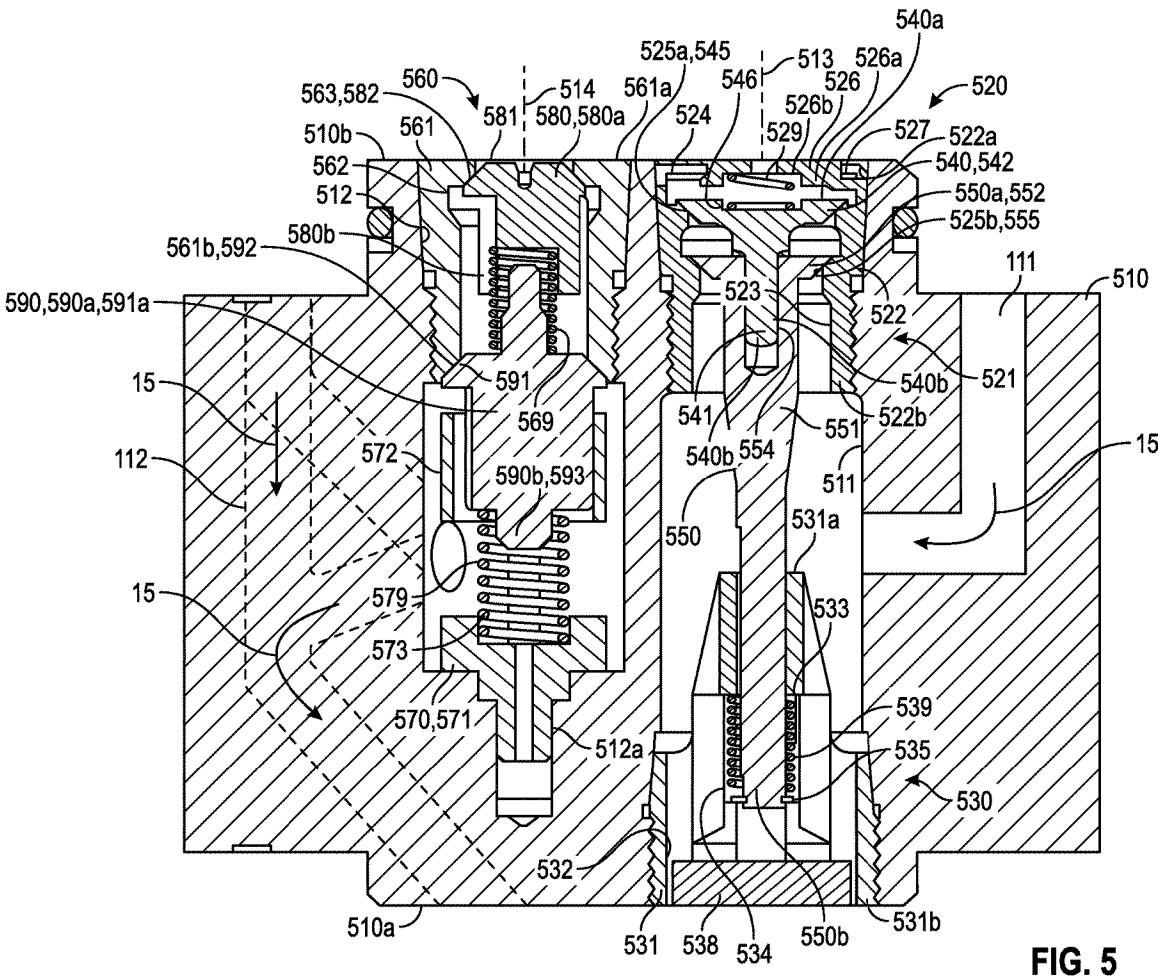
FIG. 5 is an enlarged cross-sectional view of the upper valve assembly of FIG. 3A.

Referring now to FIG. 5, upper valve assembly 500 includes valve body 510, well fluids inlet valve 520 mounted within valve body 510, and well fluids outlet valve 560 mounted in valve body 510. Valve body 510 has a first or upper end 510*a* coupled to coupling 45 and a second or lower end 510*b* coupled to housing upper end 110*a*. Second end 510*b* comprises a planar end face oriented perpendicular to axis 105 and defining the upper end of well fluids section 121*a* of piston chamber 121. In addition, valve body 510 includes a throughbore 511 extending axially between ends 510*a*, 510*b*, and a counterbore 512 extending axially from end 510*b* and circumferentially-spaced from bore 511. Bores 511, 512 have central axes 513, 514, respectively. Valves 520, 560 are removably disposed in counterbores 511, 512, respectively.

In this embodiment, both inlet valve 520 and outlet valve 560 are double poppet valves. Inlet valve 520 includes a seating assembly 521 disposed in bore 511 at end 510*b*, a retention assembly 530 disposed in bore 511 at end 510*b*, a primary poppet valve member 540, and a backup or secondary poppet valve member 550 telescopically coupled to primary poppet valve member 540. Retention assembly 521, seating assembly 530, and valve members 540, 550 are coaxially aligned with bore axis 513.

Seating assembly 521 includes a seating member 522 threaded into bore 511 at end 510*b*, an end cap 526, and a biasing member 529. Seating member 522 has a first end 522*a* proximal body end 510*b*, a second end 522*b* disposed in bore 511 opposite end 522*a*, and a central through passage 523 extending axially between ends 522*a*, 522*b*. In addition, the radially inner surface of seating member 522 includes an annular recess 524 proximal end 522*a*, a first annular shoulder 525*a* axially spaced from recess 524, and a second annular shoulder 525*b* axially spaced from shoulder 525*a*.

First annular shoulder 525*a* is axially disposed between recess 524 and shoulder 525*b*. As will be described in more detail below, valve members 540, 550 move into and out of engagement with shoulders 525*a*, 525*b*, respectively, to transition between closed and opened positions. Thus, annular shoulders 525*a*, 525*b* may also be referred as valve seats 525*a*, 525*b*, respectively.

Figure 7:
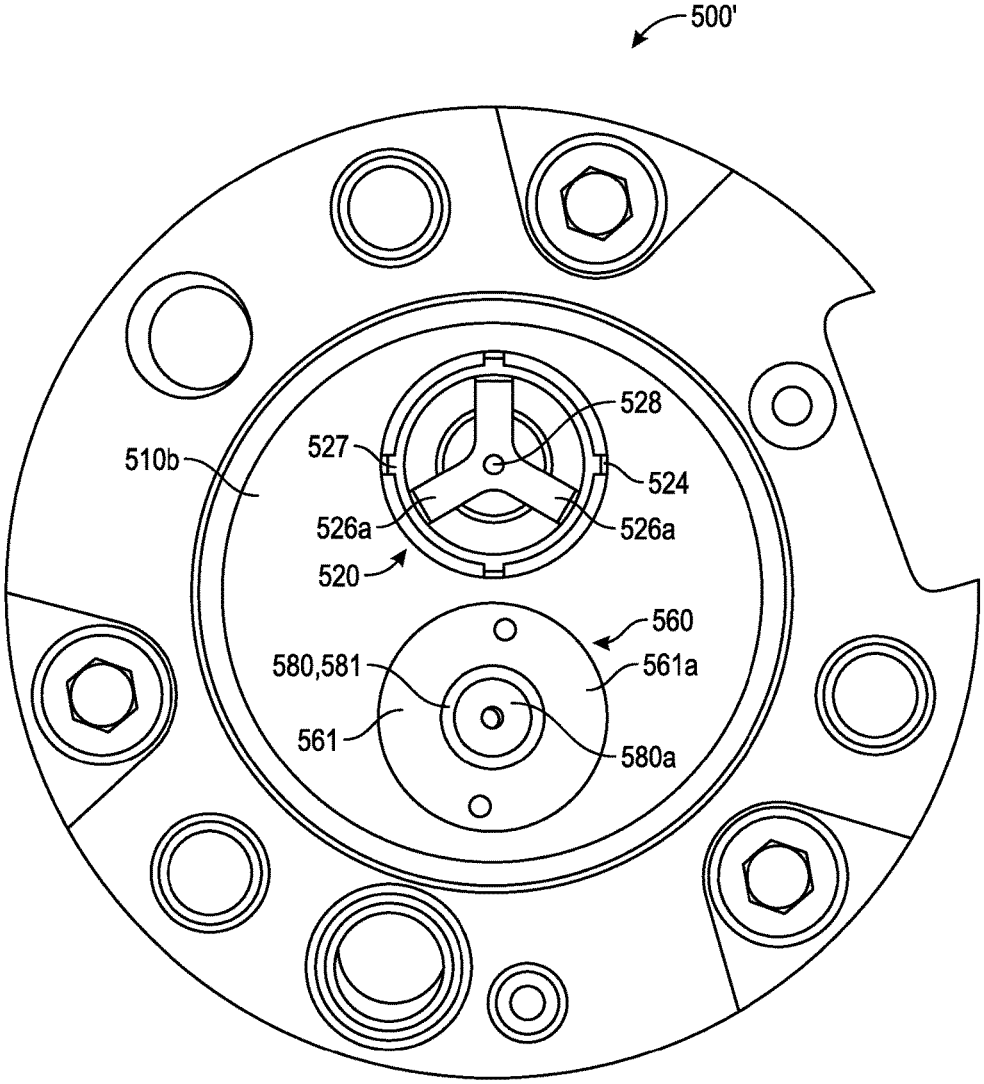
FIG. 7 is an enlarged end view of the lower valve assembly of FIG. 5.

End cap 526 is disposed in passage 523 at end 522*a* and is maintained within passage 523 with a snap ring 527 that extends radially into retention member recess 524. As best shown in FIG. 7, in this embodiment, end cap 526 includes a plurality of radially extending arms 526*a* and a central throughbore 528. The voids or spaces circumferentially disposed between adjacent arms 526*a*, as well as central throughbore 528, allow well fluids 15 to flow axially across end cap 526.

Referring again to FIG. 5, biasing member 529 is axially compressed between end cap 526 and primary valve member 540. Thus, biasing member 529 biases primary valve member 540 axially away from end cap 526 and into engagement with valve seat 525*a*. In other words, biasing member 529 biases primary valve member 540 to a "closed" position. Specifically, when primary valve member 540 is seated in valve seat 525*a*, axial fluid flow through inlet valve 520 between inlet passage 111 and section 121*a* is restricted and/or prevented. In this embodiment, biasing member 529 is seated in a cylindrical recess 526*b* in end cap 526, which restricts and/or prevents biasing member 529 from moving radially relative to end cap 526. Although biasing member 529 is a coil spring in this embodiment, in general, biasing member (e.g., biasing member 529) may comprise any suitable device for biasing the primary valve member (e.g., valve member 540) to the closed position.

Referring still to Figure and 5, retention assembly 530 includes a retention member 531 threaded into bore 511 at end 510*a*, an end cap 538, and a biasing member 539. Retention member 531 has a first end 531*a* disposed in bore 511 and a second end 531*b* flush with end 510*a*. In addition, retention member 531 includes a central through passage 532 extending axially between ends 531*a*, 531*b*, and an annular shoulder 533 axially positioned between ends 531, b in passage 532. End cap 538 is threaded into passage 532 at end 531*b* and closes off passage 532 and bore 511 at end 531*b*.

Secondary valve member 550 extends axially into passage 532. In particular, secondary valve member 550 slidingly engages retention member 531 between end 531*a* and shoulder 533, but is radially spaced from retention member 531 between shoulder 533 and end 531*b*. A retention ring 534 disposed about secondary valve member 550 is axially positioned between shoulder 533 and end 531*b*. A snap ring 535 disposed about secondary valve member 550 prevents retention ring 534 from sliding axially off of secondary valve member 550. Thus, biasing member 539 biases secondary valve member 550 axially towards end 510*b* and into engagement with valve seat 525*b*. In other words, biasing member 539 biases secondary valve member 550 to a "closed" position. Specifically, when secondary valve member 550 is seated in valve seat 525*b*, axial fluid flow through inlet valve 520 between inlet passage 111 and section 121*a* is restricted and/or prevented. Although biasing member 539 is a coil spring in this embodiment, in general, biasing member (e.g., biasing member 539) may comprise any suitable device for biasing the primary valve member (e.g., valve member 550) to the closed position.

Referring still to FIG. 5, valve members 540, 550 have first ends 540*a*, 550*a*, respectively, and second ends 540*b*, 550*b*, respectively. In addition, each valve member 540, 550 includes a elongate valve stem 541, 551, respectively, extending axially from end 540*b*, 550*b*, respectively, and a valve head 542, 552, respectively, that extends radially outward from valve stem 541, 551, respectively, at end 540*a*, 550*b*, respectively. Further, each valve head 542, 552 includes a sealing surface 545, 555, respectively, that mates with and sealingly engages valve seat 525*a*, 525*b*, respectively, when valve head 542, 552, respectively, is seated therein. In this embodiment, sealing surfaces 545, 555, and mating surfaces of valve seats 525*a*, 525*b*, respectively, are spherical.

Stem 551 of secondary valve member 550 extends axially into passage 532 and includes an annular recess in which snap ring 535 is seated. Secondary valve member 550 also includes a central counterbore 554 extending axially from end 550*a* through head 552 and into stem 551. Stem 541 of primary valve member 540 is slidingly received by counterbore 554. Further, head 542 of primary valve member 540 includes a cylindrical recess 546. Biasing member 529 is seated in recess 546, which restricts and/or prevents biasing member 529 from moving radially relative to valve head 542.

As previously described, during pumping operations, inlet valve 520 of upper valve assembly 500 controls the supply of well fluids 15 to section 121*a*. In particular, valve members 540, 550 are biased to closed positions engaging seats 525*a*, 525*b*, respectively, and valve heads 542, 552, are axially positioned between seats 525*a*, 525*b*, respectively, and section 121*a*. Thus, when the pressure in chamber 121*a* is equal to or greater than the pressure in passage 111, valves heads 542, 552 sealingly engage valve seats 525*a*, 525*b*, respectively, thereby restricting and/or preventing fluid flow between passage 111 and section 121*a*. However, as piston 600 begins to move axially downward within chamber 121, the volume of section 121*a* increases and the pressure therein decreases. As the pressure in section 121*a* drops below the pressure in passage 111, the pressure differential seeks to urge valves members 540, 550 axially downward and out of engagement with seats 525*a*, 525*b*, respectively. Biasing members 529, 539 bias valve members 540, 550, respectively, in the opposite axial direction and seek to maintain sealing engagement between biasing members valve heads 542, 552 and valve seats 525*a*, 525*b*, respectively. However, once the pressure in section 121*a* is sufficiently low (i.e., low enough that the pressure differential between section 121 a and passage 111 is sufficient to overcome biasing member 529), valve member 540 unseats from seat 525*a* and compresses biasing member 529. Then, almost instantaneously, the combination of the relatively low pressure in section 121*a* and relatively high pressure of well fluids in passage 111 overcomes biasing member 539, valve member 550 unseats from seat 525*b* and compresses biasing member 539, thereby transitioning inlet valve 520 to an "opened" position allowing fluid communication between passage 111 and section 121*a*. Since the pressure in section 121*a* is less than the pressure of well fluids 15 in passage 111, well fluids 15 will flow through inlet valve 520 into section 121*a* from passage 111. In this embodiment, biasing members 529, 539 provide different biasing forces. In particular, biasing member 529 provides a lower biasing force than biasing member 539 (e.g., biasing member 529 is a lighter duty coil spring than biasing member 539).

After piston 600 reaches its axially innermost stroke end proximal distribution system 130 and begins to move axially upward within chamber 121, the volume of chamber 121*a* decreases and the pressure therein increases. Once the pressure in section 121*a* in conjunction with the biasing forces provided by biasing members 529, 539 are sufficient to overcome the pressure in passage 111, valve members 540, 550 move axially upward and seat against valve seats 525*a*, 525*b*, respectively, thereby transitioning back to the closed positions restricting and/or preventing fluid communication between section 121*a* and passage 111.

Referring still to FIG. 5, outlet valve 560 includes a seating member 561 disposed in counterbore 512 at end 510*b*, a guide member 570 disposed in counterbore 512 distal end 510*b*, a primary poppet valve member 580, and a backup or secondary poppet valve member 590 telescopically coupled to primary poppet valve member 580. Retention member 561, guide member 570, and valve members 580, 590 are coaxially aligned with counterbore axis 514.

Seating member 561 is threaded into counterbore 512 at end 510*b* and has a first end 561*a* flush with body end 501*b*, a second end 561*b* disposed in counterbore 512 opposite end 561*a*, and a central through passage 562 extending axially between ends 561*a*, 561*b*. In addition, the radially inner surface of seating member 561 includes an annular shoulder 563 proximal end 561*a*. As will be described in more detail below, valve members 580, 590 move into and out of engagement with shoulder 563 and end 561*b*, respectively, to transition between closed and opened positions. Thus, annular shoulder 563 and seat member end 561*b* may also be referred as valve seats 563, 561*b*, respectively.

Valve member 580 is disposed in passage 562 and has a first end 580*a* and a second end 580*b* opposite end 580*a*. End 580*a* comprises a radially enlarged valve head 581 that mates with and sealingly engages valve seat 563. In this embodiment, valve head 581 includes a spherical sealing surface 582 that sealingly engages a mating spherical surface of valve seat 563. A biasing member 569 is axially compressed between valve members 580, 590. Thus, biasing member 569 biases primary valve member 580 axially away from valve member 590 and into engagement with valve seat 563. In other words, biasing member 569 biases primary valve member 580 to a "closed" position. Specifically, when primary valve member 580 is seated in valve seat 563, fluid communication between outlet passage 113 and section 121*a* is restricted and/or prevented. In this embodiment, biasing member 569 is seated in a cylindrical counterbore 583 extending axially from end 580*b*, thereby restricting and/or preventing biasing member 569 from moving radially relative to valve member 580. Although biasing member 569 is a coil spring in this embodiment, in general, biasing member (e.g., biasing member 569) may comprise any suitable device for biasing the primary valve member (e.g., valve member 580) to the closed position.

Referring still to FIG. 5, guide member 570 is disposed in counterbore 512 and includes a base section 571 seated in a recess 512*a* extending axially from counterbore 512, a valve guide section 572 disposed about valve member 590, and a plurality of circumferentially-spaced arms 573 extending axially between sections 571, 572. A biasing member 579 is axially compressed between valve member 590 and base section 571. Thus, biasing member 579 biases secondary valve member 590 axially away from base section 571 and into engagement with valve seat 561*b*. In other words, biasing member 579 biases primary valve member 590 to a "closed" position. Specifically, when primary valve member 590 is seated in valve seat 561*b*, fluid communication between outlet passage 113 and section 121*a* is restricted and/or prevented. In this embodiment, biasing member 579 is seated in a cylindrical counterbore 574 in base section 571 and is radially disposed inside arms 573, thereby restricting and/or preventing biasing member 579 from moving radially relative to guide member 570. Although biasing member 579 is a coil spring in this embodiment, in general, biasing member (e.g., biasing member 579) may comprise any suitable device for biasing the primary valve member (e.g., valve member 590) to the closed position.

Valve member 590 is disposed in passage 562 and has a first end 590*a* and a second end 590*b* opposite end 590*a*. End 590*a* comprises a radially enlarged valve head 591 that mates with and sealingly engages valve seat 561*b*. In this embodiment, valve head 591 includes a spherical sealing surface 592 that sealingly engages a mating spherical surface of valve seat 561*b*. As previously described, biasing member 579 biases valve member 590 into sealing engagement with seat 561*b*. In addition, in this embodiment, end 590*b* comprises a cylindrical tip 593 that extends axially into biasing member 579, thereby restricting and/or preventing biasing member 579 and valve member 590 from moving radially relative to each other.

As previously described, during pumping operations, outlet valve 560 of upper valve assembly 500 controls the flow of well fluids 15 from section 121*a* into conduit 40. In particular, valve members 580, 590 are biased to closed positions engaging seats 563, 561*b*, respectively, and valve seats 563, 561*b* are axially positioned between valve heads 581, 591, respectively, and section 121*a*. Thus, when the pressure in chamber 121*a* is less than the pressure in passage 113 and coupling 45, valves heads 581, 591 sealingly engage valve seats 563, 561*b*, respectively, thereby restricting and/or preventing fluid flow between coupling 45 and section 121*a*. However, as piston 600 begins to move axially upward within chamber 121, the volume of section 121*a* decreases and the pressure therein increases. As the pressure in section 121 a increases above the pressure in passage 112 and coupling 45, the pressure differential seeks to urge valves members 580, 590 axially upward and out of engagement with seats 563, 561*b*, respectively. Biasing members 569, 579 bias valve members 580, 590, respectively, in the opposite axial direction and seek to maintain sealing engagement between biasing members valve heads 581, 591 and valve seats 563, 561*b*, respectively. However, once the pressure in section 121*a* is sufficiently high (i.e., high enough that the pressure differential between section 121*a* and passage 112 is sufficient to overcome biasing members 569), valve member 580 will unseat from seat 563 and compresses biasing member 569. Then, almost instantaneously, the combination of the relatively high pressure in section 121*a* and relatively lower pressure in passage 112 overcome biasing member 579, valve member 590 unseats from seat 561*b*, thereby transitioning outlet valve 560 to an "opened" position allowing fluid communication between passage 112 and section 121*a*. Since the pressure in section 121*a* is greater than the pressure of well fluids 15 in passage 112, well fluids 15 will flow through outlet valve 560 from section 121*a* into passage 112, coupling 45, and conduit 40. In this embodiment, biasing members 569, 579 provide different biasing forces. In particular, biasing member 569 provides a lower biasing force than biasing member 579 (e.g., biasing member 569 is a lighter duty coil spring than biasing member 579).

After piston 600 reaches its axially outermost stroke end distal distribution system 130 and begins to move axially downward within chamber 121, the volume of chamber 121*a* increases and the pressure therein decreases. Once the pressure in coupling 45 in conjunction with the biasing forces provided by biasing members 569, 579 are sufficient to overcome the pressure in section 121*a*, valve members 580, 590 move axially downward and seat against valve seats 563, 561*b*, respectively, thereby transitioning back to the closed positions restricting and/or preventing fluid communication between section 121*a* and coupling 45.

Figure 6:
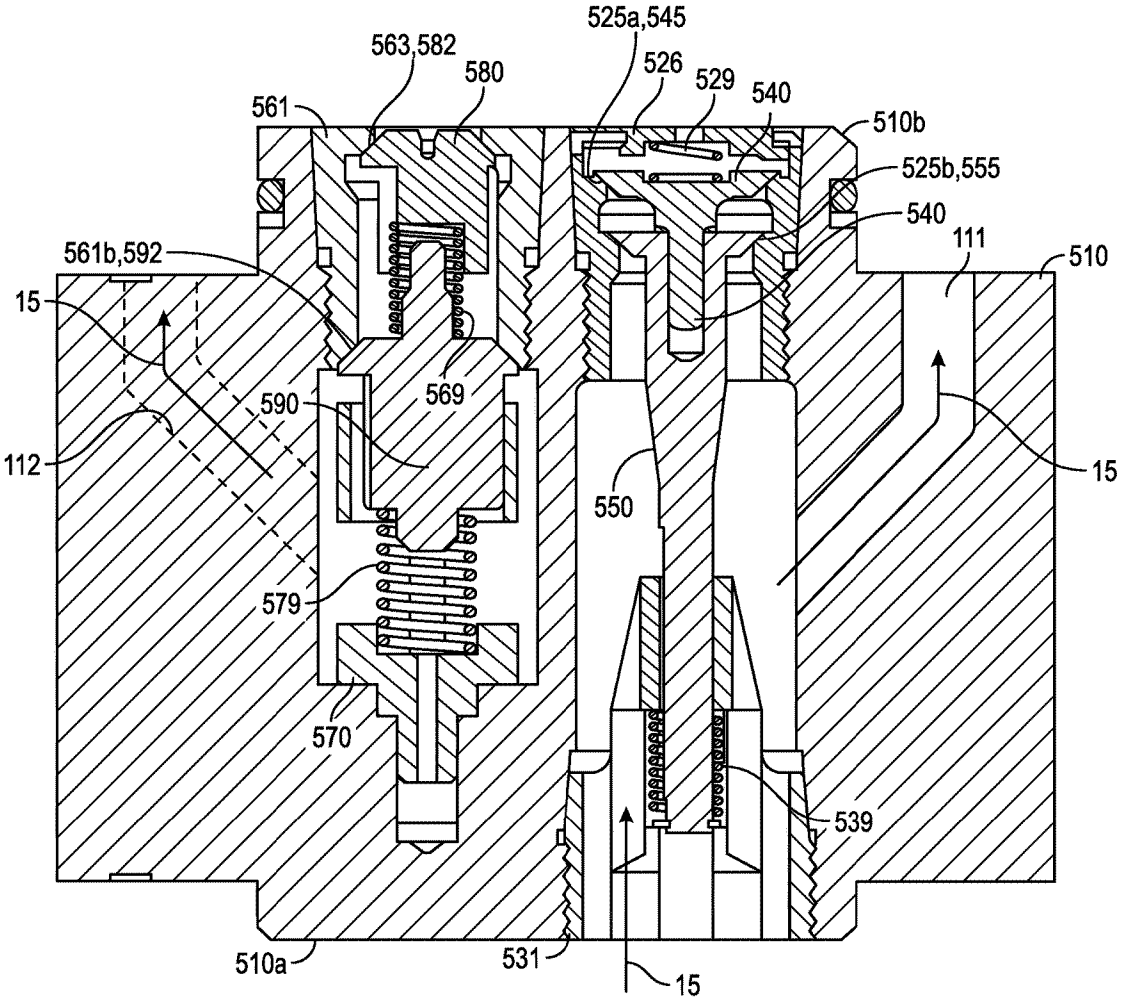
FIG. 6 is an enlarged cross-sectional view of the lower valve assembly of FIG. 3B.

Referring now to FIG. 6, lower valve assembly 500' is substantially the same as upper valve assembly 500 previously described. Namely, lower valve assembly 500' includes valve body 510, well fluids inlet valve 520 mounted within valve body 510, and well fluids outlet valve 560 mounted in valve body 510, each as previously described. However, lower valve assembly 500' is flipped 180° relative to upper valve assembly 500'. Thus, first end 510*a* of valve body 510 of lower valve assembly 500' is the lower end, and second end 510*b* of valve body 510 of lower valve assembly 500' is the upper end. The second or upper end 510*b* of valve body 510 of lower valve assembly 500' comprises a planar end face oriented perpendicular to axis 105 and defining the lower end of well fluids section 125*a* of piston chamber 125. In addition, lower valve assembly 500' is axially disposed between lower end 110*b* of fluid end pump housing 120 and hydraulic pump 200, inlet valve 520 of lower valve assembly 500' controls the supply of well fluids 15 to section 125*a*, and outlet valve 560 of lower valve assembly 500' controls the flow of well fluids 15 from section 125*a* into conduit 40 via passage 113 and coupling 45. Further, seating assembly 521 of lower valve assembly 500' does not include end cap 538. Thus, inlet valve 520 of lower valve assembly 500' is in fluid communication with well fluids flow passage 116. Although FIG. 7 illustrates an end view of end 510*b* of lower valve assembly 500', it is also representative of an end view of end 510*b* of upper valve assembly 500. In particular, end views of valves 520, 560 of each valve assembly 500, 500' at ends 510*b* are the same.

As previously described, during pumping operations, inlet valve 520 of lower valve assembly 500' controls the supply of well fluids 15 to section 125*a*. In particular, valve members 540, 550 are biased to closed positions engaging seats 525*a*, 525*b*, respectively, and valve heads 542, 552, are axially positioned between seats 525*a*, 525*b*, respectively, and section 121*a*. Thus, when the pressure in chamber 125*a* is equal to or greater than the pressure in well fluids flow passage 116, valves heads 542, 552 sealingly engage valve seats 525*a*, 525*b*, respectively, thereby restricting and/or preventing fluid flow between well fluids flow passage 116 and section 125*a*. However, as piston 600' begins to move axially upward within chamber 125, the volume of section 125*a* increases and the pressure therein decreases. As the pressure in section 125*a* drops below the pressure in well fluids flow passage 116, the pressure differential seeks to urge valves members 540, 550 axially downward and out of engagement with seats 525*a*, 525*b*, respectively. Biasing members 529, 539 bias valve members 540, 550, respectively, in the opposite axial direction and seek to maintain sealing engagement between biasing members valve heads 542, 552 and valve seats 525*a*, 525*b*, respectively. However, once the pressure in section 125*a* is sufficiently low (i.e., low enough that the pressure differential between section 125*a* and well fluids flow passage 116 is sufficient to overcome biasing members 529, 539), valve members 540, 550 will unseat from seats 525*a*, 525*b*, respectively, thereby transitioning inlet valve 520 of lower valve assembly 500' to an "opened" position allowing fluid communication between well fluids flow passage 116 and section 125*a*. Since the pressure in section 125*a* is less than the pressure of well fluids 15 in well fluids flow passage 116, well fluids 15 will flow through inlet valve 520 into section 125*a* from well fluids flow passage 116. In this embodiment, biasing members 529, 539 provide different biasing forces. In particular, biasing member 529 provides a lower biasing force than biasing member 539 (e.g., biasing member 529 is a lighter duty coil spring than biasing member 539). Thus, valve member 540 of lower valve assembly 500' will unseat just before valve member 550 of lower valve assembly 500'.

After piston 600' reaches its axially innermost stroke end proximal distribution system 130 and begins to move axially downward within chamber 125, the volume of chamber 125*a* decreases and the pressure therein increases. Once the pressure in section 125*a* in conjunction with the biasing forces provided by biasing members 529, 539 are sufficient to overcome the pressure in well fluids flow passage 116, valve members 540, 550 move axially upward and seat against valve seats 525*a*, 525*b*, respectively, thereby transitioning back to the closed positions restricting and/or preventing fluid communication between section 125*a* and well fluids flow passage 116.

Referring still to FIG. 6, as previously described, during pumping operations, outlet valve 560 of lower valve assembly 500' controls the flow of well fluids 15 from section 125*a* into conduit 40 via passage 112 and coupling 45. In particular, valve members 580, 590 are biased to closed positions engaging seats 563, 561*b*, respectively, and valve seats 563, 561*b* are axially positioned between valve heads 581, 591, respectively, and section 125*a*. Thus, when the pressure in chamber 125*a* is less than to or greater than the pressure in passage 112 and coupling 45, valves heads 581, 591 sealingly engage valve seats 563, 561*b*, respectively, thereby restricting and/or preventing fluid flow between coupling 45 and section 125*a*. However, as piston 600' begins to move axially downward within chamber 125, the volume of section 125*a* decreases and the pressure therein increases. As the pressure in section 125*a* increases above the pressure in passage 112, the pressure differential seeks to urge valves members 580, 590 axially upward and out of engagement with seats 563, 561*b*, respectively. Biasing members 569, 579 bias valve members 580, 590, respectively, in the opposite axial direction and seek to maintain sealing engagement between biasing members valve heads 581, 591 and valve seats 563, 561*b*, respectively. However, once the pressure in section 125*a* is sufficiently high (i.e., high enough that the pressure differential between section 125*a* and passage 112 is sufficient to overcome biasing members 569, 579), valve members 580, 590 will unseat from seats 563, 561*b*, respectively, thereby transitioning outlet valve 560 of lower valve assembly 500' to an "opened" position allowing fluid communication between section 125*a* and passage 112. Since the pressure in section 125*a* is greater than the pressure of well fluids 15 in passage 112, well fluids 15 will flow through outlet valve 560 from section 125*a* into passage 112, coupling 45, and conduit 40. In this embodiment, biasing members 569, 579 provide different biasing forces. In particular, biasing member 569 provides a lower biasing force than biasing member 579 (e.g., biasing member 569 is a lighter duty coil spring than biasing member 579). Thus, valve member 580 of lower valve assembly 500' will unseat just before valve member 590 of lower valve assembly 500'.

After piston 600' reaches its axially outermost stroke end distal distribution system 130 and begins to move axially upward within chamber 125, the volume of chamber 125*a* increases and the pressure therein decreases. Once the pressure in passage 112 in conjunction with the biasing forces provided by biasing members 569, 579 are sufficient to overcome the pressure in section 125*a*, valve members 580, 590 move axially downward and seat against valve seats 563, 561*b*, respectively, thereby transitioning back to the closed positions restricting and/or preventing fluid communication between section 125*a* and passage 112.

In the manner described, inlet valve 520 and outlet valve 560 of upper valve assembly 500 control the flow of well fluids 15 into and out of section 121*a*, and inlet valve 520 and outlet valve 560 of lower valve assembly 500' control the flow of well fluids 15 into and out of section 125*a*. Each valve 520, 560 includes two poppet valve members adapted to move into and out of engagement with mating valve seats. Namely, inlet valve 520 includes poppet valve members 540, 550, and outlet valve 560 includes poppet valve members 580, 590. Valve members 540, 550 are capable of operating independent of one another. Thus, valve member 540 may seat against valve seat 525*a* even if valve member 550 is not seated against valve seat 525*b*, and vice versa. Likewise, valve members 580, 590 are capable of operating independent of one another. Thus, valve member 580 may seat against valve seat 563 even if valve member 590 is not seated against valve seat 561*b*, and vice versa. Inclusion of multiple, serial, operationally independent valve members 540, 550 in inlet valve 520 offers the potential to enhance the reliability and sealing of inlet valve 520 in harsh downhole conditions. For example, even if valve member 540 gets stuck in the opened position (e.g., solids get jammed between valve member 540 and seat 525*a*), valve member 550 can still sealingly engage valve seat 525*b*, thereby closing inlet valve 520. Likewise, inclusion of multiple, serial, operationally independent valve members 580, 590 in outlet valve 560 offers the potential to enhance the reliability and sealing of inlet valve 560 in harsh downhole conditions. For example, even if valve member 590 gets stuck in the opened position (e.g., solids get jammed between valve member 590 and seat 561*b*), valve member 580 can still sealingly engage valve seat 563, thereby closing outlet valve 560.

Referring again to FIGS. 3A and 3B, as previously described, pistons 600, 600' are connected by rod 180, which extends axially through distribution system 130. In particular, rod 180 has a first or upper end 180*a* coupled to first piston 600 within chamber 121, a second end 180*b* coupled to second piston 600 in chamber 125, and a throughbore 181 extending axially between ends 180*a*, 180*b* and pistons 600, 600'.

Referring now to FIGS. 8A-8D, piston 600 is shown and will be described it being understood that piston 600' is identical to piston 600 with the exception that piston 600' is coupled to end 180*b* of rod 180, whereas piston 600 is coupled to end 180*a* of rod 180, and further, piston 600 axially engages first pushrod 141 and upper valve assembly 500 within chamber 121, whereas piston 600' axially engages second pushrod 142 and lower valve assembly 500' within chamber 125. In this embodiment, piston 600 includes an outer body or housing 601 and a decompression or relief valve 620 disposed in housing 601. As will be described in more detail below, decompression valves 620 of pistons 600, 600' allow selective fluid communication between sections 121*a*, 125*a* of well fluids chambers 121, 125.

Referring still to FIGS. 8A-8D, piston housing 601 has a central or longitudinal axis 605 coaxially aligned with axis 105, a first or upper end 601*a* distal rod 180, a second or lower end 601*b* proximal rod 180, a generally cylindrical radially outer surface 602 extending axially between ends 601*a*, 601*b*, and a radially inner surface 610 extending axially between ends 601*a*, 601*b*. Piston housing 601 also includes an annular recess 614 on outer surface 602 and a plurality of circumferentially-spaced drain ports 615, each drain port 615 extends radially from recess 614 to inner surface 610. As will be described in more detail below, recess 614 and ports 615 are designed and positioned to drain any well fluids that flow from section 121*a* between piston 600 and pump housing 120, thereby reducing the potential for such well fluids to undesirably contaminate hydraulic fluid in section 121*b*.

A plurality of annular seals 604, 605 are mounted to outer surface 602 of piston housing 601 and slidingly engage pump housing 120. Each seal 604, 605 forms an annular static seal with piston housing 601 and an annular dynamic seal with pump housing 120, thereby restricting and/or preventing the flow of fluids (well fluids and hydraulic fluid) between piston 600 and pump housing 120. Select seals 604, 605 are axially positioned on opposite sides of recess 614 and drain ports 615. More specifically, a first plurality of seals 604, collectively identified with reference numeral "603*a*," are axially positioned between end 601*a* and drain ports 615, while a second plurality of seals 604, 605, collectively identified with reference numeral "603*b*," are axially positioned between end 601*b* and drain ports 615. Thus, any well fluids in section 121*a* that pass first plurality of seals 603*a* drain into ports 615 before reaching second plurality of seals 603*b*, and any hydraulic fluid in section 121*b* that passes second plurality of seals 603*b* drain into recess 614 and ports 615 before reaching first plurality of seals 603*a*. Since first plurality of seals 603*a* see well fluids, they may also be referred to as "well fluid seals," and since second plurality of seals 603*b* see hydraulic fluid, they may also be referred to as "hydraulic fluid seals." Although seals 604, 605 can seal against both gases and liquids, in this embodiment, seals 604 are primarily designed to seal against liquids, whereas seals 605 are primarily designed to seal against gases.

Referring still to FIGS. 8A-8D, inner surface 610 defines a throughbore 611 extending axially between ends 601*a*, 601*b* and includes axially spaced annular, planar shoulders 612, 613. Shoulder 612 is axially positioned proximal end 601*a* and shoulder 613 is axially positioned proximal end 601*b*. Decompression valve 620 is disposed in throughbore 611 and allows selective fluid communication between section 121*a* containing well fluids and throughbore 181 in rod 180. In particular, decompression valve 620 has a closed position shown in FIGS. 8A and 8B restricting and/or preventing fluid flow between section 121*a* and throughbore 181, and an open position shown in FIGS. 8C and 8D allowing fluid flow between section 121*a* and throughbore 181. As will be described in more detail below, decompression valve 620 is biased to the closed position, but can be transitioned to the open position upon axially impacting valve assembly 500 or by a sufficient pressure differential between section 121 a and throughbore 181.

In this embodiment, decompression valve 620 includes a radially outer valve body or housing 630, a valve member 640 moveably disposed in valve body 630, an elongate guide 650 disposed in valve body 630, and a plurality of biasing members 660*a*, 660*b*, 660*c*, 660*d* disposed about guide 650 within valve body 630. Decompression valve 620 is maintained within piston housing 601 by an end cap 670 coaxially disposed in throughbore 611 at end 601*a* and secured to piston housing 601 against shoulder 612 with a snap ring 671.

Figure 8A:
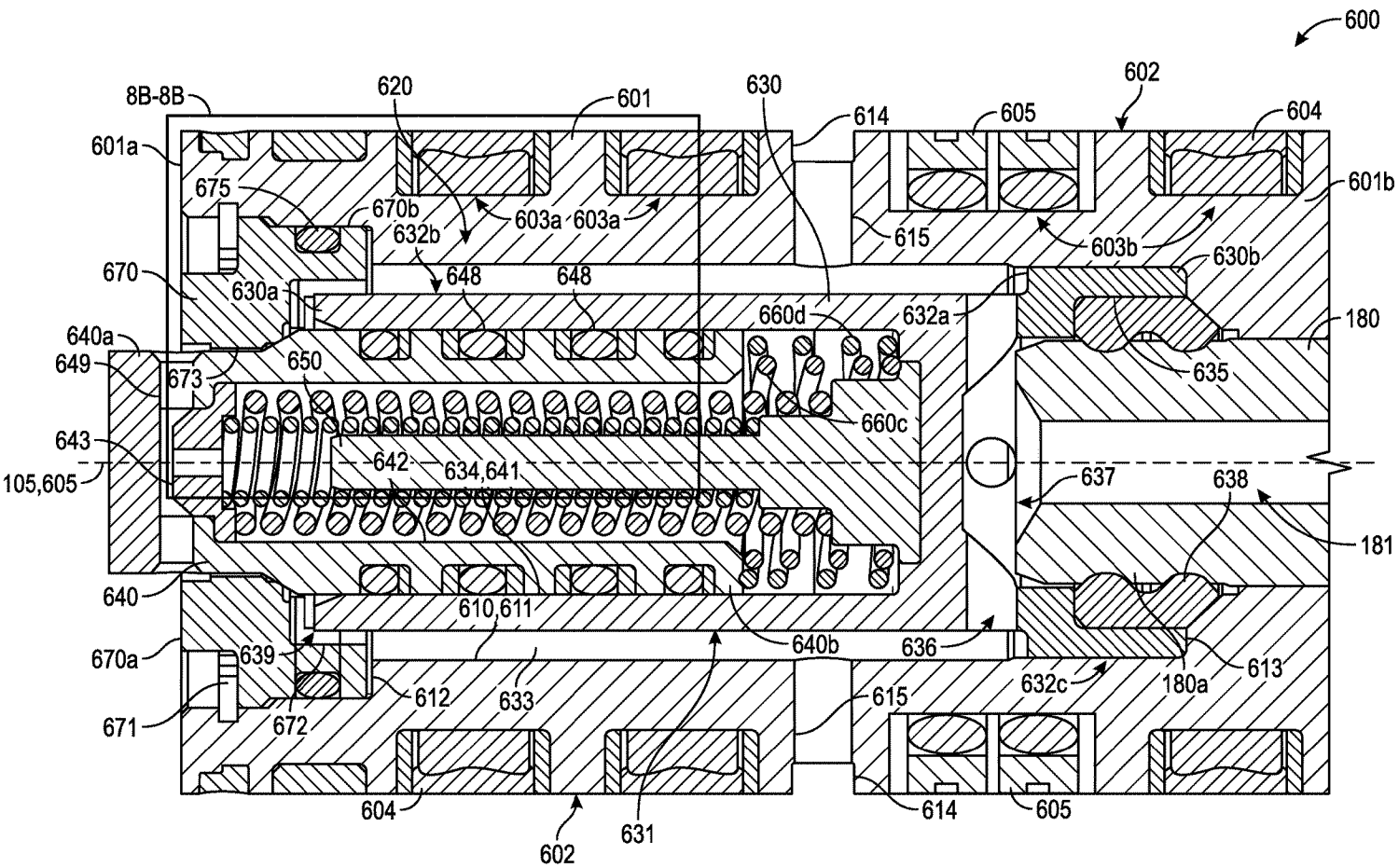
FIG. 8A is an enlarged cross-sectional view of one of the pistons of the fluid end pump FIGS. 3A and 3B with the decompression valve in a closed position.
Figure 8B:
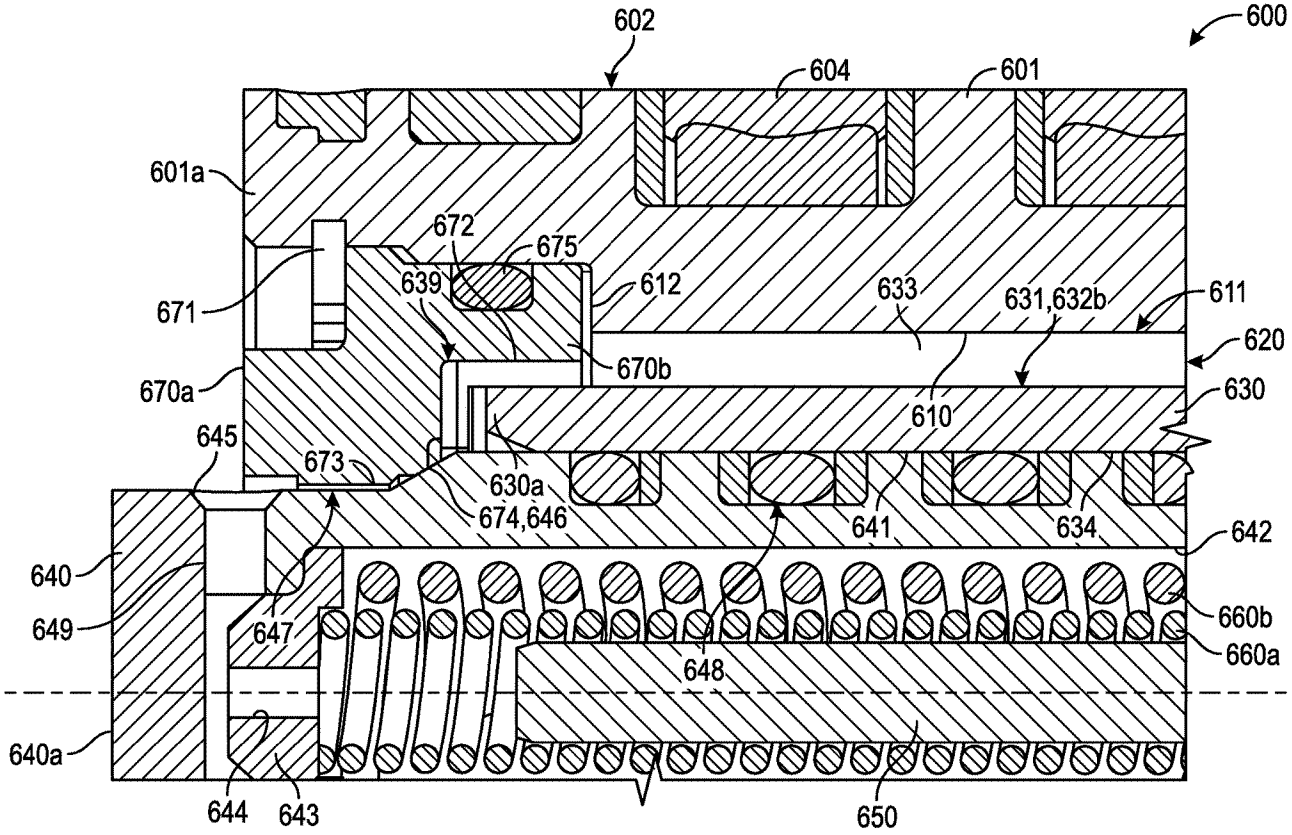
FIG. 8B is an enlarged partial view of cross section 8B-8B of FIG. 8A.
Figure 8C:
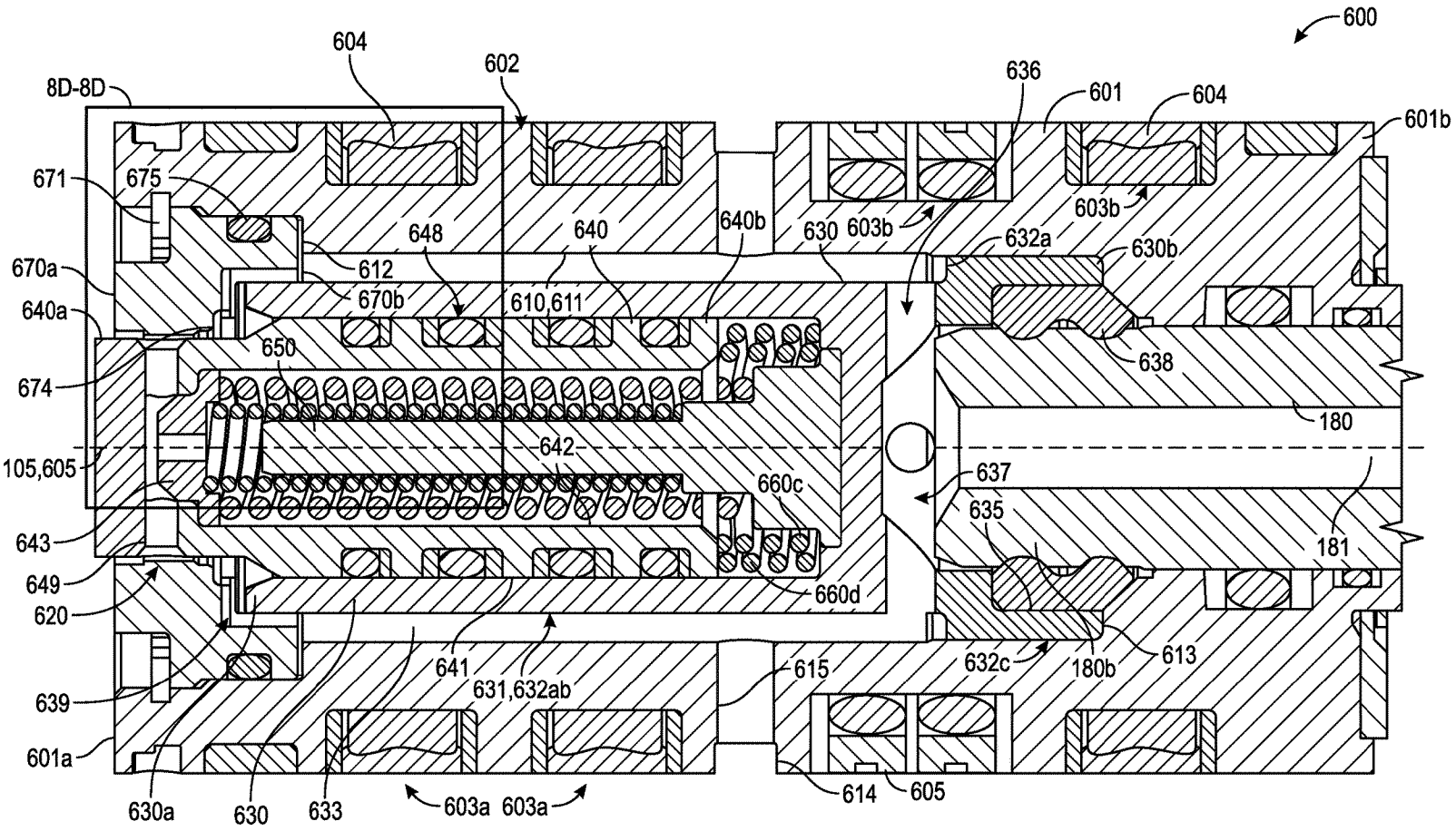
FIG. 8C is an enlarged cross-sectional view of one of the pistons of the fluid end pump FIGS. 3A and 3B with the decompression valve in an open position.
Figure 8D:
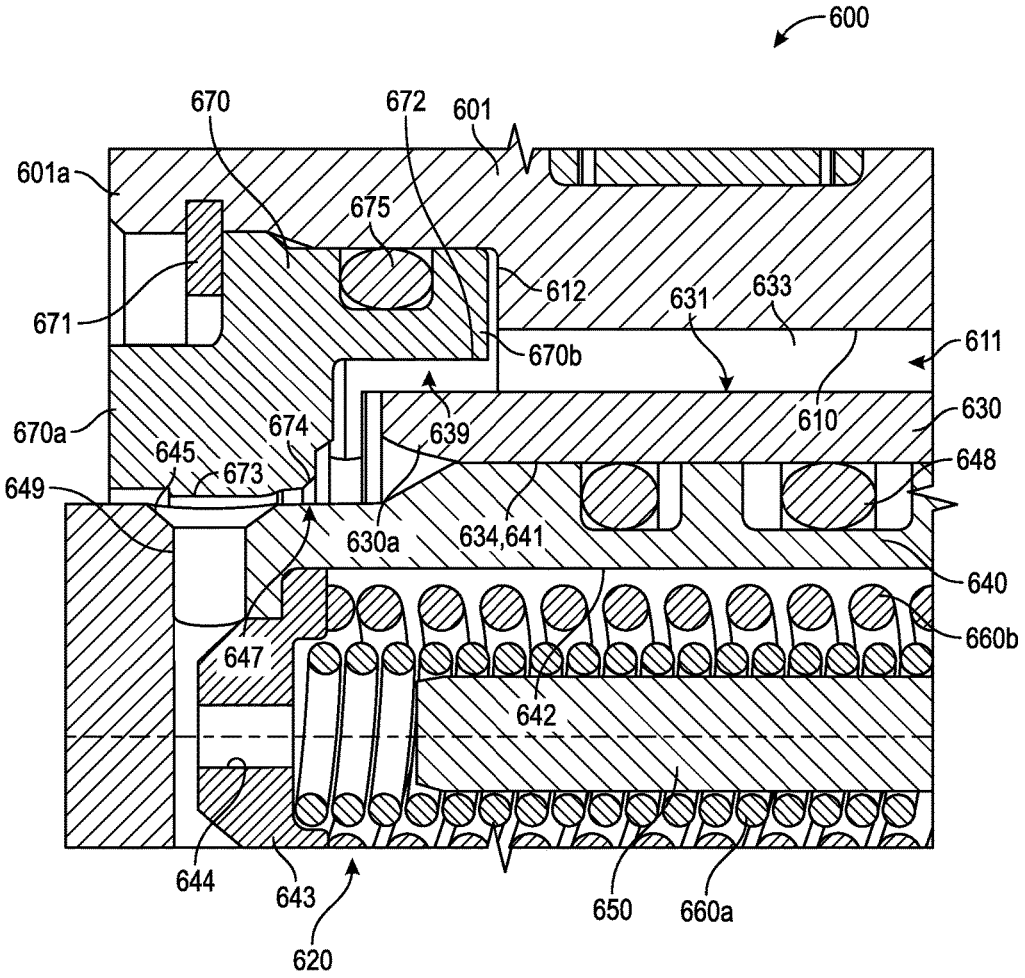
FIG. 8D is an enlarged partial view of cross section 8D-8D of FIG. 8C.

End cap 670 has a first or upper end 670*a*, a second or lower end 670*b*, a counterbore 672 extending axially from end 670*b*, and a throughbore 673 extending axially from end 670*a* to counterbore 672. As best shown in FIGS. 8B and 8D, an annular frustoconical valve seat 674 is positioned at the intersection of counterbore 672 and throughbore 673. An annular seal 675 is mounted to end cap 670 and engages piston housing 601. Seal 675 forms an annular static seal with end cap 670 and an annular static seal with piston housing 601, thereby restricting and/or preventing fluid flow between end cap 670 and piston housing 601.

Referring still to FIGS. 8A-8D, valve body 630 is coaxially disposed in piston housing 601 and has a first or upper end 630*a*, a second or lower end 630*b*, and a radially outer surface 631 extending axially between ends 603*a*, 630*b*. In addition, valve body 630 includes a counterbore 634 extending axially from end 630*a*, a counterbore 635 extending axially from end 630*b*, and a plurality of circumferentially-spaced flow passages or bores 636 extending radially from outer surface 631 to a bore 637 extending axially from counterbore 635.

Outer surface 631 includes an annular shoulder 632*a* positioned proximal end 630*b*, thereby dividing outer surface 631 into a first cylindrical section 632*b* extending axially from end 630*a* to shoulder 632*a* and a second cylindrical section 632*c* extending axially from end 630*b* to shoulder 632*a*. Flow passages 636 are axially positioned adjacent shoulder 632*a* between end 630*a* and shoulder 632*a*. Second cylindrical section 632*c* slidingly engages inner surface 610, however, first cylindrical section 632*b* is radially spaced from inner surface 610 of piston housing 601, thereby defining an annular space or annulus 633 therebetween.

Valve body 630 is disposed in throughbore 611 with end 630*b* axially abutting and seated against shoulder 613. End 630*a* extends into counterbore 672 of end cap 670. However, end 630*a* is axially spaced from end cap 670 and first cylindrical section 632*b* is radially spaced from end cap 670, resulting in an annular flow passage 639 that extends radially along end 630*a* and axially first cylindrical section 632*b* to annulus 633.

End 180*a* of rod 180 is positioned in counterbore 635 and bore 637, and thus, throughbore 181 is in fluid communication with radial flow passages 636. End 180*a* is secured within piston 600 and counterbore 635 with a locking ring 638 seated in counterbore 635. Ring 638 is wedged between piston housing 601 and rod 180, thereby urging ring 638 into positive engagement with mating annular recesses provided on the outer surface of rod 180.

Referring still to FIGS. 8A-8D, valve member 640 is coaxially aligned with piston housing 601 and is moveably disposed in counterbore 634. In addition, valve member 640 extends axially from counterbore 634 through counterbore 672 and throughbore 673 of end cap 670. Valve member 640 has a first or upper end 640*a* extending axially from piston housing 601 and end cap 670, a second or lower end 640*b* disposed in counterbore 634 of valve body 630, a radially outer surface 641 extending axially between ends 640*a*, 640*b*, and a counterbore 642 extending axially from end 640*b*. In this embodiment, a spring retainer 643 is seated in counterbore 642 distal end 640*b*. Spring retainer 643 includes an axial throughbore 644. Although this embodiment includes a separate spring retainer 643 slidingly disposed in counterbore 642, in other embodiments, the spring retainer (e.g., spring retainer 643) can be integral or monolithic with the remainder of the valve member (e.g., valve member 640).

As best shown in FIGS. 8B and 8D, outer surface 641 includes an annular frustoconical recesses 645 axially positioned proximal end 640*a* and an annular frustoconical shoulder 646 axially positioned between recess 645 and end 640*b*. As will be described in more detail below, shoulder 646 is sized and positioned to mate and engage frustoconical valve seat 674 of end cap 670 to form an annular tapered metal-to-metal seal. When decompression valve 620 is in the closed position shown in FIGS. 8A and 8B, shoulder 646 engages valve seat 674, and when decompression valve 620 is in the opened position shown in FIGS. 8C and 8D, shoulder 646 is axially spaced from valve seat 674. A small annular clearance or annulus 647 is radially positioned between end cap 670 and the portion of valve member 640 extending between end 640*a* and shoulder 646. A plurality of annular seals 648 are mounted to outer surface 641 of valve member 640 and slidingly engage valve body 630. Each seal 648 forms an annular static seal with valve member 640 and an annular dynamic seal with valve body 630, thereby restricting and/or preventing the flow of fluids (well fluids and hydraulic fluid) therebetween. Valve member 640 also includes a plurality of circumferentially-spaced radial passages or ports 649 axially positioned between end 640*a* and shoulder 646. Each port 649 extends radially from recess 645 and is in fluid communication with counterbore 642 via throughbore 644 of spring retainer 643.

Referring again to FIGS. 8A-8D, guide 650 is seated against valve body 630 within counterbore 634 and extends axially into counterbore 642 of valve member 640. Guide 650 has an outer surface 651 comprising a plurality of axially spaced planar annular shoulders. Biasing members 660*a*, 660*b*, 660*c*, 660*d* are disposed about guide 650. In addition, biasing member 660*a* is axially compressed between spring retainer 643 and the radially innermost shoulder of guide 650; biasing member 660*b* is disposed about biasing member 660*a* and is axially compressed between spring retainer 643 and a second shoulder of guide 650; biasing member 660*c* is disposed about biasing members 660*a*, 660*b* and is axially compressed between end 640*b* of valve member 640 and a third shoulder of guide 650; and biasing member 660*d* is disposed about biasing members 660*a*, 660*b*, 660*c* and is axially compressed between end 640*b* of valve member 640 and valve body 630. Thus, biasing members 660*a*, 660*b*, 660*c*, 660*d* bias shoulder 646 into sealing engagement with valve seat 674 of end cap 670. In this embodiment, each biasing member 660*a*, 660*b*, 660*c*, 660*d* is a coiled spring.

As previously described, decompression valve 620 is biased closed with shoulder 646 of valve member 640 engaging valve seat 674 of end cap 670. With decompression valve 620 in the closed position (FIGS. 8A and 8B), well fluids section 121*a* is in fluid communication with counterbores 634, 642 via recess 645, ports 649, and throughbore 644, however, the tapered metal-to-metal seal between shoulder 646 and valve seat 674 restricts and/or prevents fluid communication between well fluids section 121*a* and flow passage 639, annulus 633, bores 636, 637, and throughbore 181. However, with decompression valve 620 in the open position (FIGS. 8C and 8D), well fluids section 121*a* is in fluid communication with counterbores 634, 642 via recess 645, ports 649, and throughbore 644, and further, shoulder 646 is axially spaced from valve seat 674, thereby allowing fluid communication between well fluids section 121*a* and throughbore 181 via recess 645, clearance annulus 647, flow passage 639, annulus 633, and bores 636, 637. Decompression valve 620 can be transitioned from the closed position to the open position (FIGS. 8C and 8D) in two different manners: (1) by physically pushing valve member 640 axially toward valve body 630 to unseat shoulder 646 from valve seat 674; and (2) by a sufficient pressure differential between section 121*a* and flow passage 639. Regarding (1), pushrod 142 of distribution system 130 is specifically sized such that as piston 600 moves axially in the first direction (to the left in FIG. 8C) to the axially outermost position relative to distribution system 130, end 640*a* of valve member 640 engages upper valve assembly 500 and is pushed into valve body 630 a sufficient axial distance to unseat shoulder 646 from valve seat 674. Regarding (2), the axially opposed surfaces of end cap 670 and valve member 640, and the axially opposed surfaces of valve member 640 and valve body 630, are sized such that a sufficient pressure differential between flow passage 639 (relatively high pressure) and well fluids section 121*a* (relatively low pressure, which also results in a relatively low pressure within counterbores 634, 642 between valve member 640 and valve body 630) overcomes the biasing force generated by biasing members 660*a*, 660*b*, 660*c*, 660*d*, thereby moving valve member 640 a sufficient axial distance relative to valve body 630 to unseat shoulder 646 from valve seat 674.

As previously described, piston 600' is identical to piston 600 with the exception that piston 600' is coupled to end 180*b* of rod 180, whereas piston 600 is coupled to end 180*a* of rod 180, and piston 600 axially engages first pushrod 141 and upper valve assembly 500 within chamber 121, whereas piston 600' axially engages second pushrod 142 and lower valve assembly 500' within chamber 125. Thus, decompression valve 620 of piston 600' has a closed position restricting and/or preventing fluid flow between section 125*a* and throughbore 181, and an open position allowing fluid flow between section 125*a* and throughbore 181. In addition, decompression valve 620 of piston 600' can be transitioned from the closed position to the open position in two different manners: (1) by physically pushing valve member 640 axially toward valve body 630 to unseat shoulder 646 from valve seat 674; and (2) by a sufficient pressure differential between section 121*a* and flow passage 639. Regarding (1), pushrod 141 of distribution system 130 is specifically sized such that as piston 600' moves axially in the second direction to the axially outermost position relative to distribution system 130, end 640*a* of valve member 640 of piston 600' engages lower valve assembly 500' and is pushed into valve body 630 a sufficient axial distance to unseat shoulder 646 from valve seat 674. Regarding (2), the axially opposed surfaces of end cap 670 and valve member 640, and the axially opposed surfaces of valve member 640 and valve body 630, are sized such that a sufficient pressure differential between flow passage 639 (relatively high pressure) and well fluids section 121*a* (relatively low pressure, which also results in a relatively low pressure within counterbores 634, 642 between valve member 640 and valve body 630) overcomes the biasing force generated by biasing members 660*a*, 660*b*, 660*c*, 660*d*, thereby moving valve member 640 a sufficient axial distance relative to valve body 630 to unseat shoulder 646 from valve seat 674. Recess 614 and drain ports 615 of piston housing 601 of piston 600' are designed and positioned to drain any well fluids that flow from section 125*a* between piston 600' and pump housing 120, thereby reducing the potential for such well fluids to undesirably contaminate hydraulic fluid in section 125*b*.

Referring again to FIGS. 3A and 3B, during operation of fluid end pump 110, pistons 600, 600' axially reciprocate within housing 120. As piston 600 compresses well fluids in section 121*a*, biasing members 660*a*, 660*b*, 660*c*, 660*d* of piston 600 maintain decompression valve 620 of piston 600 in the closed position since valve member 640 of piston 600 is pressure balanced via fluid communication between section 121*a* and counterbores 634, 642, and the pressure within flow passage 639 of piston 600 is insufficient to overcome biasing members 660*a*, 660*b*, 660*c*, 660*d*. In addition, biasing members 660*a*, 660*b*, 660*c*, 660*d* of piston 600' maintain decompression valve 620 of piston 600' in the closed position since valve member 640 of piston 600' is pressure balanced via fluid communication between section 125*a* and counterbores 634, 642, and the pressure within flow passage 639 of piston 600' is insufficient to overcome biasing members 660*a*, 660*b*, 660*c*, 660*d*. However, decompression valve 620 of piston 600 is transitioned open at the end of the compression stroke of piston 600 in response to the axial impact of end 640*a* of valve member 640 in piston 600 with upper valve assembly 500. Once decompression valve 620 of piston 600 is opened, the relatively high pressure well fluids in section 121*a* flow from section 121*a* to flow passage 639 of piston 600' via (a) recess 645, clearance annulus 647, flow passage 639, annulus 633, and bores 636, 637 of piston 600, (b) throughbore 181 of rod 180, and (c) bores 636, 637 and annulus 633 of piston 600'. The relatively high pressure well fluids in flow passage 639 of piston 600' is sufficient to overcome the biasing force of biasing members 660*a*, 660*b*, 660*c*, 660*d* of piston 600' and transition decompression valve 620 of piston 600' open, thereby allowing decompression of the relatively high pressure well fluids in section 121*a* into the relatively low pressure well fluids in section 125*a*. Once the well fluid pressures in sections 121*a*, 125*a* are equalized and piston 600 disengages upper valve assembly 500 as piston 600' begins its compression stroke, decompression valves 620 of pistons 600, 600' are closed by biasing members 660*a*, 660*b*, 660*c*, 660*d*. Similarly, as piston 600' compresses well fluids in section 125*a* biasing members 660*a*, 660*b*, 660*c*, 660*d* of piston 600' maintain decompression valve 620 of piston 600' in the closed position since valve member 640 of piston 600' is pressure balanced via fluid communication between section 125*a* and counterbores 634, 642, and the pressure within flow passage 639 of piston 600' is insufficient to overcome biasing members 660*a*, 660*b*, 660*c*, 660*d*. In addition, biasing members 660*a*, 660*b*, 660*c*, 660*d* of piston 600 maintain decompression valve 620 of piston 600 in the closed position since valve member 640 of piston 600 is pressure balanced via fluid communication between section 121*a* and counterbores 634, 642, and the pressure within flow passage 639 of piston 600 is insufficient to overcome biasing members 660*a*, 660*b*, 660*c*, 660*d*. However, decompression valve 620 of piston 600' is transitioned open at the end of the compression stroke of piston 600' in response to the axial impact of end 640*a* of valve member 640 in piston 600' with lower valve assembly 500'. Once decompression valve 620 of piston 600' is opened, the relatively high pressure well fluids in section 125*a* flow from section 125*a* to flow passage 639 of piston 600 via (a) recess 645, clearance annulus 647, flow passage 639, annulus 633, and bores 636, 637 of piston 600', (b) throughbore 181 of rod 180, and (c) bores 636, 637 and annulus 633 of piston 600. The relatively high pressure well fluids in flow passage 639 of piston 600 is sufficient to overcome the biasing force of biasing members 660*a*, 660*b*, 660*c*, 660*d* of piston 600 and transition decompression valve 620 of piston 600 open, thereby allowing decompression of the relatively high pressure well fluids in section 125*a* into the relatively low pressure well fluids in section 121*a*. Once the well fluid pressures in sections 121*a*, 125*a* are equalized and piston 600' disengages lower valve assembly 500' (as piston 600 begins its compression stroke), decompression valves 620 of pistons 600, 600' are closed by biasing members 660*a*, 660*b*, 660*c*, 660*d*.

The well fluids pumped by fluid end pump 110 may contain gas, especially when pump 100 is used to dewater gas wells. Without being limited by this or any particular theory, gases are generally compressible, whereas water and hydraulic fluid are generally incompressible. The ability to decompress the well fluids in section 121*a*, 125*a* being pressurized to the other section 125*a*, 121*a*, respectively, offers the potential to improve the operability of fluid end pump 110 when pumping well fluids containing variable amounts of gas. In particular, decompression valves 620 stabilize the response of distribution system 130 by allowing decompression of the gas in the well fluids to avoid the restitution effect, which can abruptly change the direction of movement of the pistons 600, thereby causing the premature disengagement of the pushrod 141, 142 and potential unseating of ball 155. Decompression valves 620 also reduce the axial forces applied to pushrods 141, 142, which may enhance the durability and operating lifetime of distribution system 130. In particular, decompression valves 620 reduce the well fluids pressure in sections 121*a*, 125*a* during pressurization, which in turn reduces the hydraulic oil pressure in sections 121*b*, 125*b* since the hydraulic oil pressure in sections 121*b*, 125*b* is a function of the resistance to movement provided by well fluids pressure in sections 121*a*, 125*a*.

As previously described, pistons 600, 600' are disposed within chambers 121, 125, respectively, and divide chambers 121, 125 into well fluids sections 121*a*, 125*a* and hydraulic fluid sections 121*b*, 125*b*. Thus, pistons 600, 600' separate hydraulic fluid in sections 121*b*, 125*b*, respectively, from well fluids in sections 121*a*, 125*a*, respectively. In addition, the well fluids pumped by fluid end pump 110 may contain gas. Since gases are generally compressible, unlike hydraulic fluid, and water does not have the desired lubricating properties of hydraulic fluid, pistons 600, 600' are designed to restrict and/or prevent the well fluids in sections 121*b*, 125*b*, respectively, from contaminating the hydraulic fluid in sections 121*a*, 125*a*, respectively. In particular, seals 604, 605 provide annular seals between piston housings 601 and pump housing 120. In addition, embodiments of pistons 600, 600' described herein include annular recess 614 and drain ports 615, which are designed and positioned to drain any well fluids (and gases contained therein) that seek to flow from section 121*a*, 125*a* into section 121*b*, 125*b*, respectively. Thus, any well fluids that pass well fluid seals 603*a* drain through recess 614 and ports 615 into flow passage 639 of the corresponding piston 600, 600', are subsequently swept away into the well fluids section 121*a*, 125*a* of the other piston 600, 600' upon decompression (i.e., when decompression valves 620 are transitioned open and relatively high pressure well fluids in section 121*a*, 125*a* are decompressed into the relatively low pressure well fluids in the other section 121*a*, 125*a*, respectively), and are eventually pumped to the surface along with the other well fluids in that section 121*a*, 125*a*.

Referring now to FIG. 3C, hydraulic pump 200 has a first or upper end 200*a* coupled to distributor 115 and a second or lower end 200*b* coupled to electric motor 300. In addition, hydraulic pump 200 includes a radially outer housing 210, a first or upper pump chamber 220 disposed in housing 210, a second or lower pump chamber 230 disposed in housing 210 and axially spaced below chamber 220, a bearing chamber 240 axially disposed between chambers 220, 230, an upper pump assembly 250 disposed in chamber 220, a lower pump assembly 280 disposed in chamber 230, and a bearing assembly 245 disposed in bearing chamber 240. As will be described in more detail below, hydraulic fluid fills chambers 220, 230, 240 and baths the components disposed in chambers 220, 230, 240.

A tubular well fluids conduit 205 extends coaxially through hydraulic pump 200 and is in fluid communication with flow passage 116 of distributor 115. As will be described in more detail below, conduit 205 supplies well fluids 15 from separator 400 to fluid end pump 110 via distributor flow passage 116. Although conduit 205 extends through hydraulic pump 200, it is not in fluid communication with any of chambers 220, 230, 240.

Referring now to FIG. 3C, housing 210 includes a tubular section 211, an upper end cap 212 coupled to section 211 and defining upper end 210*a*, and a lower end cap 213 coupled to the opposite end of section 211 and defining lower end 210*b*. Hydraulic fluid return passage 114 extends axially through end cap 212 to pump chamber 220. The radially inner surface of tubular section 211 includes an upwardly facing annular shoulder 211*a*, and a downwardly facing annular shoulder 211*b* axially spaced from shoulder 211*a*. Upper chamber 220 is axially disposed between shoulder 211*a* and upper end cap 212, lower chamber 230 is axially disposed between shoulder 211*b* and lower end cap 213, and bearing chamber 240 is axially disposed between shoulders 211*a,b*. Hydraulic fluid supply passage 214 extends axially through tubular section 211 and is in fluid communication with a plurality of hydraulic fluid supply passages or branches 215, 216 extending through end caps 212, 213, respectively. Due to the orientation of the cross-section of pump 200 shown in FIG. 3C, passage 214, one branch 215, and one branch 216 are schematically shown. However, there are multiple branches 215 in end cap 212 that are in fluid communication with passage 214, and multiple branches 216 in end cap 213 that are in fluid communication with passage 214. Each branch 215, 216 includes a check valve 217 that allows one-way fluid flow from its corresponding branch 215, 216 into passage 214.

Passage 214 is in fluid communication with hydraulic fluid passage 113 of fluid end pump 110 previously described. Thus, hydraulic pump 200 supplies pressurized hydraulic fluid to distribution system 130 via branches 215, 216 and passages 214, 113. As previously described, hydraulic fluid return passage 114 allows hydraulic fluid from distribution system 130 to return to upper chamber 220, which is in fluid communication with compensator 350. End caps 212, 213 include throughbores 218, 219, respectively, through which conduit 205 extends.

Referring still to FIG. 3C, upper pump assembly 250 is disposed in chamber 220 and includes a guide member 251, a plurality of elongate, circumferentially-spaced pistons 255 (only one visible in FIG. 3C), a biasing member 260, a biasing sleeve 261, a top hat or swivel plate 265, and a wobble plate 270. Guide member 251, swivel plate 265, biasing member 270, biasing sleeve 271, and wobble plate 280 are each disposed about conduit 205. In this embodiment, upper pump assembly 250 includes three uniformly circumferentially-spaced pistons 255.

Guide member 251 axially abuts end cap 212 and is fixably secured thereto with bolts (not visible in the cross-section shown in FIG. 3C). Guide member 251 includes a central throughbore 252, a plurality of circumferentially-spaced piston guide bores 253 radially spaced from central throughbore 252, and an axially extending counterbore 254 coaxially aligned with throughbore 252 and facing the remainder of assembly 250. Biasing member 260 is seated in counterbore 254, and biasing sleeve 261 is disposed about biasing member 260 and slidingly engages counterbore 254.

As will be described in more detail below, biasing member 260 is compressed between guide member 251 and biasing sleeve 261, and thus, biases biasing sleeve 261 axially away from guide member 251. Each guide bore 253 is aligned with and in fluid communication with one of the branches 215 in end cap 212. In addition, one piston 255 is telescopically received by and extends axially from each of the piston guide bores 253.

Biasing sleeve 261 has a first or upper end 261*a* disposed in counterbore 254, a second end 261*b* opposite end 261*a*, and a radially inner surface including an annular shoulder 262 between ends 261*a*, 261*b* and a frustoconical seat 263 at end 261*b*. Biasing member 260 axially abuts annular shoulder 262 and guide member 251, and swivel plate 265 is pivotally seated in seat 263.

Each piston 255 is disposed at the same radial distance from axis 105 and has a first end 255*a* disposed in one bore 253, a second end 255*b* axially positioned between swivel plate 265 and wobble plate 270, and a throughbore 256 extending axially between ends 255*a*, 255*b*. Throughbore 256 of each piston 255 is in fluid communication with its corresponding bore 253. In this embodiment, end 255*b* of each piston 255 comprises a spherical head 257.

Referring still to FIG. 3C, swivel plate 265 includes a base 266 at least partially seated in seat 263 and a flange 267 extending radially outward from base 266 outside of seat 263. Base 266 has a generally curved, convex radially outer surface that slidingly engages seat 263, thereby allowing swivel plate 265 to pivot relative to biasing sleeve 261. Flange 267 includes a planar end face opposing wobble plate 270 and a plurality of circumferentially-spaced bores 269. One piston 255 extends axially through each bore 269. A piston retention ring 290 is disposed about each piston head 257, and is axially positioned between flange 267 and piston head 257. Each retention ring 290 has a planar surface engaging planer end face 268 and a frustoconical concave seat within which spherical piston head 257 is pivotally seated. Each retention ring 290 maintains sliding engagement with both flange 267 and its corresponding piston head 257 as swivel plate 265 pivot relative to biasing sleeve 261.

It should be appreciated that swivel plate 265 is disposed about conduit 205 but radially spaced from conduit 205 by a radial distance that provides sufficient clearance therebetween as swivel plate 265 pivots relative to biasing sleeve 261. Likewise, each bore 269 in swivel plate 265 has a diameter greater than the outside diameter of the portion of piston 255 extending therethrough to provide sufficient clearance therebetween as swivel plate 265 pivots relative to that piston 255.

Figure 9:
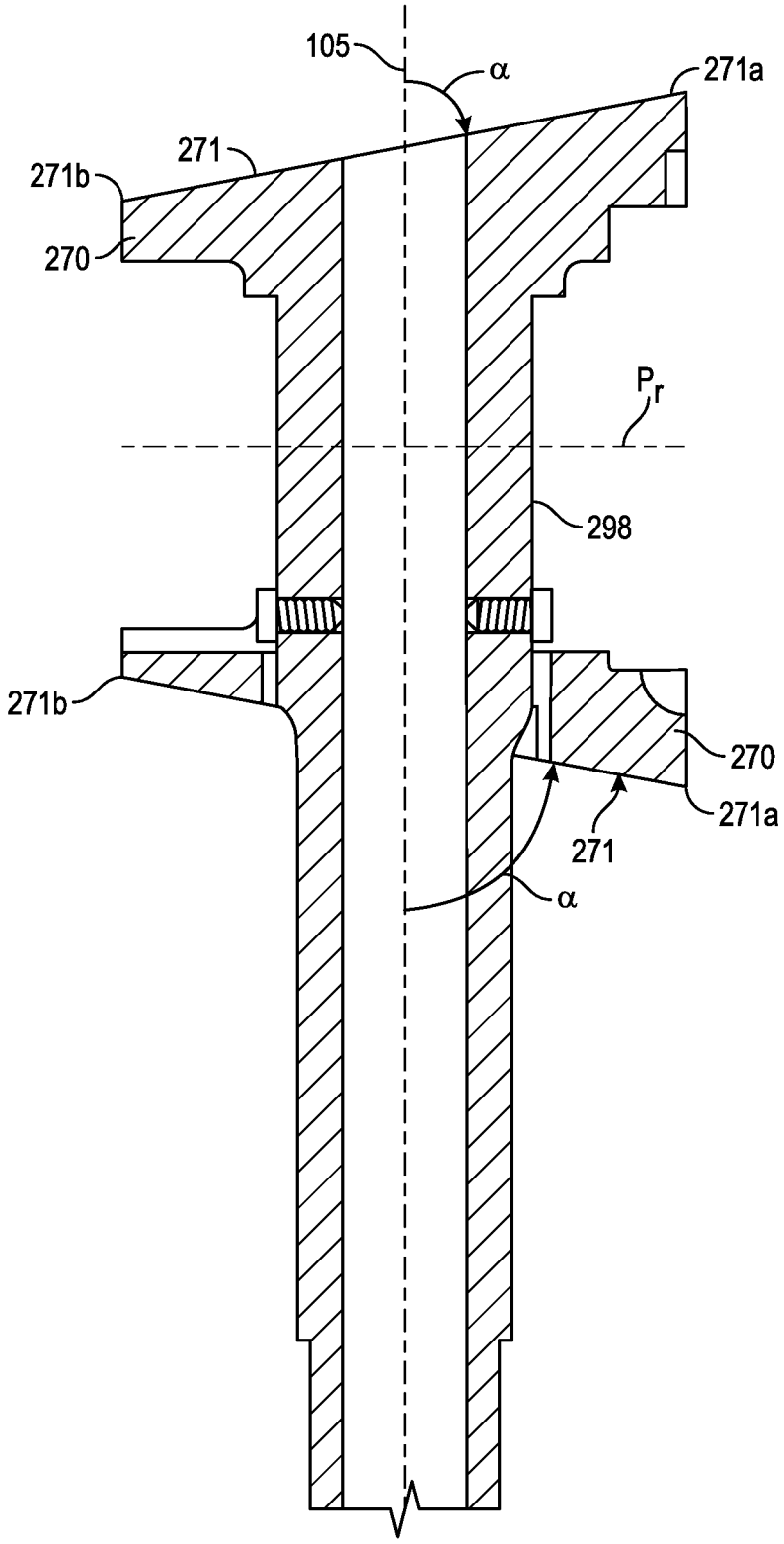
FIG. 9 is an enlarged cross-sectional view of the wobble plates of the hydraulic pump of FIG. 3C.
Figure 10:
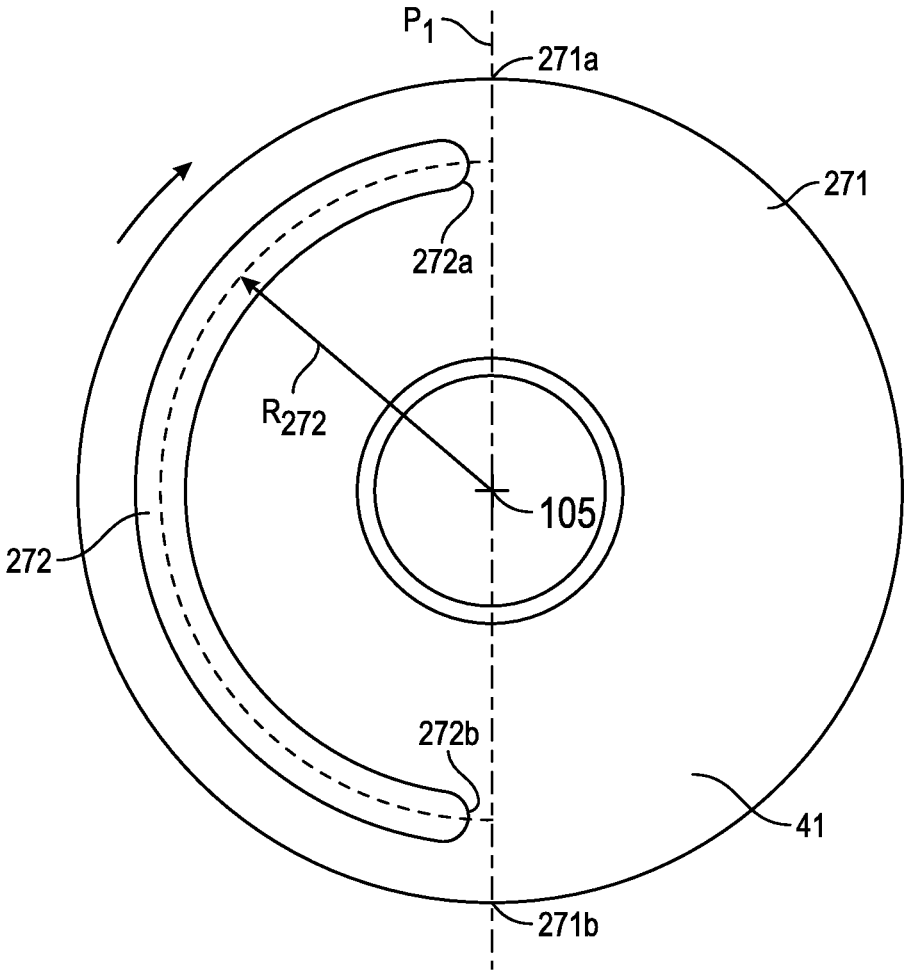
FIG. 10 is a top view of the wobble plate of the upper pump assembly of FIG. 3C.

Referring now to FIGS. 3C, 9, and 10, wobble plate 270 comprises a planar end face 271 opposed flange end face 269 and an arcuate slot 272 extending axially through plate 270. End face 271 is oriented at an acute angle a relative to axis 105. Angle a is preferably between 0° and 60°, more preferably between 0° and 20°, and even more preferably between 8° and 18°. Due to its angular orientation relative to axis 105, end face 271 slopes from an axially outermost point 271*a* relative to a reference plane $P_r$ perpendicular to axis 105 and axially positioned between pump assemblies 250, 280, and an axially innermost point 271*b* relative to a reference plane $P_r$. Points 271*a*, 271*b* are 180° apart relative to axis 105. Since end face 271 of wobble plate 270 of upper pump assembly 250 faces upwards, point 271*a* represents the axially uppermost point on end face 271 and point 271*b* represents the axially lowermost point on end face 271. As will be described in more detail below, end face 271 of wobble plate 270 of lower pump assembly 280 faces downwards, and thus, corresponding point 271 represents the axially lowermost point on end face 271 of wobble plate 270 of lower pump assembly 280 and corresponding point 271*b* represents the axially uppermost point on end face 271 of wobble plate 270 of lower pump assembly 280.

As best shown in FIG. 10, slot 272 is disposed at a uniform radial distance $R_{272}$ relative to axis 105, and has a first end 272*a* and a second end 272*b* angularly spaced slightly less than 180° from first end 272*a* about axis 105. In this embodiment, each end 272*a*, 272*b* is circumferentially adjacent or proximal a reference plane $P_1$ passing through points 271*a*, 271*b* and containing axis 105. Each spherical piston head 257 is disposed at the same radial distance $R_{272}$ from axis 105. Thus, piston heads 257 are aligned with slot 272.

Referring briefly to FIG. 3C, a piston interface shoe 295 is disposed about each piston head 257, and is axially positioned between wobble plate 270 and piston head 257. Each interface shoe 295 has a planar surface slidingly engaging planer end face 271 and a spherical concave seat within which spherical piston head 257 is pivotally seated.

Referring now to FIGS. 3C and 9, a tubular drive shaft 298 is coaxially disposed about conduit 205 and drives the rotation of wobble plate 270 about axis 105. In this embodiment, drive shaft 298 is integral with and monolithically formed with wobble plate 270 of upper pump assembly 250. However, in other embodiments, the drive shaft that drives the rotation of a wobble plate may be a distinct and separate component that is coupled to the wobble plate. An annular clearance is provided between the radially inner surface of driveshaft 298 and conduit 205.

As wobble plate 270 rotates, the axial distance from each piston guide bore 253 to wobble plate end face 271 cyclically varies. For example, the axial distance from a given guide bore 253 and end face 271 is maximum when the "thin" portion of wobble plate 270 is axially opposed that guide bore 253, and the axial distance from a given guide bore 253 and end face 271 is minimum when the "thick" portion of wobble plate 270 is axially opposed that guide bore 253. However, pistons 255 move axially back and forth within bores 253 to maintain piston head 257 axially adjacent end face 271. Specifically, biasing member 260 biases biasing sleeve 261 axially into swivel plate 265, which in turn, biases retention rings 290 and corresponding piston heads 257 against end face 271. Sliding engagement of swivel plate and bias sleeve seat 263 allows simultaneous axial biasing of swivel plate 265 and pivoting of swivel plate 265 relative to biasing sleeve 261. It should also be appreciated that engagement of each spherical piston head 257 with a corresponding mating frustoconical seat in both retention ring 290 and shoe 295 enables ring 290 and shoe 295 to slidingly engage head 257 and pivot about head 257 while maintaining contact with head 257 and plates 265, 270, respectively.

As wobble plate 270 rotates, pistons 255 reciprocate axially within guide bores 253 and slot 272 cyclically moves into and out of fluid communication with bore 256 of each piston 255. In particular, wobble plate 270 is rotated such that bore 256 of each piston 255 first comes into fluid communication with slot 272 at end 272*a* and moves out of fluid communication with slot 272 at end 272*b*. Thus, bore 256 of each piston 255 is in fluid communication with slot 272 as corresponding piston head 257 moves axially downward and away from guide member 251 as it is biased against end face 271. Accordingly, bore 256 of each piston 255 is in fluid communication with slot 272 as piston 255 telescopically extends axially from its corresponding bore 253. As previously described, check valve 217 in each branch 215 only allows one-way fluid communication from bore 253 to corresponding branch 215. Thus, as each piston 255 extends from its corresponding guide bore 253, the fluid pressure within associated bores 253, 256 decreases and hydraulic fluid within chamber 220 flows through slot 272 and fills bores 253, 256. As will be described in more detail below, compensator 350 maintains hydraulic fluid in chambers 220, 230, 240 at a fluid pressure sufficient to push hydraulic fluid into pistons 255 when piston bores 256 are in fluid communication with chambers 220, 230, 240 via slot 272.

Conversely, once each piston 256 moves out of fluid communication with slot 272, corresponding piston head 257 moves axially upward and toward guide member 251. Accordingly, bore 256 of each piston 255 is isolated from (i.e., not in fluid communication with) slot 272 as piston 255 is telescopically pushed axially into its corresponding bore 253. As each piston 255 is axially pushed further into its corresponding guide bore 253, the hydraulic fluid in associated bores 253, 256 is compressed. As previously described, check valve 217 in each branch 215 only allows one-way fluid communication from bore 253 to corresponding branch 215. Thus, when the hydraulic fluid in bores 253, 256 is sufficiently compressed (i.e., the pressure differential across check valve 217 exceeds the cracking pressure of check valve 217), corresponding check valve 217 will open and allow the pressurized hydraulic fluid in bores 253, 256 to flow into associated branch 215 and passage 214.

Referring again to FIGS. 3C and 9, lower pump assembly 280 is disposed in chamber 230 and is the same as upper pump assembly 250 previously described. Namely, lower pump assembly 280 includes a guide member 251 (fixably secured to end cap 213 with bolts not visible in the cross-section of FIG. 3C), three elongate, circumferentially-spaced pistons 255 (only one visible in FIG. 3C), a biasing member 260, a biasing sleeve 261, a swivel plate 265, and a wobble plate 270, each as previously described. However, the components of lower pump assembly 280 are inverted such that end faces 271 of wobble plates 270 face away from each other—end face 271 of upper wobble plate 270 faces end cap 212 and end face 271 of lower wobble plate 270 faces end cap 213. Consequently, axially outermost point 271 a of end face 271 of lower wobble plate 270 is the axially lowermost point on end face 271 and axially innermost point 271*b* of end face 271 of lower wobble plate 270 is the axially uppermost point on end face 271. Further, unlike wobble plate 270 of upper pump assembly 250 which is integral with driveshaft 298, wobble plate 270 of lower pump assembly 280 is disposed about driveshaft 298 and keyed to driveshaft 298 such that wobble plate 270 of lower pump assembly 280 rotates along with driveshaft 298 and wobble plate 270 of upper pump assembly 250.

Lower pump assembly 280 functions in the same manner as upper pump assembly 280 to supply pressurized hydraulic fluid to distribution system 130. However, each guide bore 253 of guide member 251 of lower pump assembly 280 is in fluid communication with one branch 216 in lower end cap 213. Thus, lower pump assembly 280 provides pressurized hydraulic fluid to distribution system 130 via branches 216 and passages 214, 113. In particular, driveshaft 298 drives the rotation of lower wobble plate 270. As lower wobble plate 270 rotates, pistons 255 of lower pump assembly 280 reciprocate axially within guide bores 253 and slot 272 in lower wobble plate 270 cyclically moves into and out of fluid communication with bore 256 of each piston 255. In particular, lower wobble plate 270 is rotated such that bore 256 of each piston 255 first comes into fluid communication with slot 272 at end 272*a* (generally aligned with point 271*a* of lower wobble plate 270) and moves out of fluid communication with sot 272 at end 272*b* (generally aligned with point 271*b* of lower wobble plate 270). Thus, bore 256 of each piston 255 is in fluid communication with slot 272 as corresponding piston head 257 moves axially upward and away from guide member 251 as it is biased against end face 271 of lower wobble plate 270. Accordingly, bore 256 of each piston 255 is in fluid communication with slot 272 of lower wobble plate as piston 255 telescopically extends axially from its corresponding bore 253. Check valve 217 in each branch 216 only allows one-way fluid communication from bore 253 to corresponding branch 216. Thus, as each piston 255 extends from its corresponding guide bore 253, the fluid pressure within associated bores 253, 256 decreases and hydraulic fluid within chamber 230 flows through slot 272 in lower wobble plate 270 and fills bores 253, 256. Conversely, once each piston 256 of lower pump assembly 280 moves out of fluid communication with slot 272 in lower wobble plate 270, corresponding piston head 257 moves axially downward and toward guide member 251. Accordingly, bore 256 of each piston 255 in lower pump assembly 280 is isolated from (i.e., not in fluid communication with) slot 272 of lower wobble plate as piston 255 is telescopically pushed axially into its corresponding bore 253. As each piston 255 of lower pump assembly 280 is axially pushed further into its corresponding guide bore 253, the hydraulic fluid in associated bores 253, 256 is compressed. As previously described, check valve 217 in each branch 216 only allows one-way fluid communication from bore 253 to corresponding branch 216. Thus, when the hydraulic fluid in bores 253, 256 is sufficiently compressed (i.e., the pressure differential across check valve 217 exceeds the cracking pressure of check valve 217), corresponding check valve 217 will open and allow the pressurized hydraulic fluid in bores 253, 256 to flow into associated branch 216 and passage 214.

In the manner described, each piston 255 of upper pump assembly 250 and lower pump assembly 280 axially reciprocates within its corresponding guide bore 253, piston bores 256 move into and out of fluid communication with slots 272, and pressurized hydraulic fluid is supplied to distribution system 130 via branches 215, 216 and passages 214, 113. Although only one piston 255 is shown in each pump assembly 250, 280, however, as previously described, in this embodiment, each pump assembly 250, 280 includes three identical, uniformly circumferentially-spaced pistons 255 that function in the same manner. Thus, at any given time during rotation of wobbles plate 270, at least one piston 255 of each assembly 250, 280 is being filled with hydraulic fluid and at least one piston 255 of each assembly 250, 280 is providing pressurized hydraulic fluid to distribution system 130. Accordingly, hydraulic pump 200 continuously provides pressurized hydraulic fluid to distribution system 130 to drive fluid end pump 110.

Referring again to FIG. 3C, it should be appreciated that wobble plates 270 are counter opposed. Namely, axially outermost point 271*a* on slanted end face 271 of upper wobble plate 270 is circumferentially aligned with axially outermost point 271*a* on slanted end face 271 of lower wobble plate 270. As a result, axially innermost points 271*b* on slanted end faces 271 of upper and lower wobble plates 270 are circumferentially aligned. Such orientation of upper wobble plate 270 relative to lower wobble plate 270 balances axial forces exerted on driveshaft 298 by upper and lower wobble plates 270. In particular, hydraulic fluid being compressed in bores 253, 256 of upper pump assembly 250 exert axially downward forces on end face 271 of upper wobble plate 270 and driveshaft 298. However, hydraulic fluid being compressed in bores 253, 256 of lower pump assembly 280 exert axially equal and opposite (i.e., upward) axial forces on end face 271 of lower wobble plate 270 and driveshaft 298, thereby counteracting the forces exerted on driveshaft 298 by upper wobble plate 270. Such balancing of axial forces on driveshaft 298 reduces axial loads supported by pump bearings 246, thereby offering the potential to improve the durability of bearings 246 and pump 200.

Referring still to FIG. 3C, bearing assembly 245 is disposed in bearing chamber 240 and includes a pair of annular radial bearings 246 disposed about driveshaft 298 that radially support rotating driveshaft 298. In general, radial bearings 246 may comprise any type of radial bearings suitable for use under the anticipated environmental conditions (e.g., temperature, fluid viscosities, etc.) including, without limitation, radial ball bearings.

Referring now to FIG. 3D, electric motor 300 has a first or upper end 300*a* coupled to hydraulic pump 200 and a lower end 300*b* coupled to compensator 350. Motor 300 includes a radially outer housing 310 and a tubular rotor or output driveshaft 320 having an upper end 320*a* coupled to driveshaft 298 previously described. Motor 300 drives the rotation of driveshaft 320, which in turn drives the rotation of driveshaft 298 and wobble plates 270, thereby powering hydraulic pump 200. Tubular conduit 205 extends axially through the coaxially aligned driveshafts 320, 298. Annular radial bearings 330 are disposed about driveshaft 320. Bearings 330 are radially positioned between housing 310 and driveshaft 320, and radially support the rotating driveshaft 320.

A controller (not shown), which may be disposed at the surface 11 or downhole, controls the speed of motor 320 in response to sensed pressure at the bottom of wellbore 20. Wires disposed in or coupled to conduit 40 provide electricity to power the operation of motor 300.

In general, motor 300 may comprises any suitable type of electric motor that converts electrical energy provided by wires in or coupled to conduit 40 into mechanical energy in the form of rotational torque and rotation of driveshaft 320. Examples of suitable electric motors include, without limitation, DC motors, AC motors, universal motors, brushed motors, permanent magnet motors, or combinations thereof. Due to the potentially high depth applications of deliquification pump 100 (e.g., depths in excess of 10,000 ft.), electric motor 300 is preferably capable of withstanding the relatively high temperatures experienced at such depths. In this embodiment, electric motor 300 is a permanent magnet motor. In addition, in this embodiment, motor housing 310 is filled with hydraulic fluid that can flow to and from hydraulic pump 200 and compensator 350. The hydraulic fluid facilitates heat transfer away from electric motor 300 and lubricates bearings 330. In particular, hydraulic fluid is continuously circulated between hydraulic pump 200 and distribution system 130 except during the inversion phase when pistons 600, 600' are stationary (i.e., when pistons 600, 600' are in the process of changing directions). During the inversion phase, the return of hydraulic fluid from distribution system 130 to hydraulic pump 200 temporarily ceases. However, pressurized hydraulic fluid from hydraulic pump 200 is still necessary to fully transition shuttle valve 160 in distribution system 130. Therefore, during the inversion phase, compensator 350 supplies hydraulic fluid to hydraulic pump 200 through motor 300. The hydraulic fluid supplied by compensator 350 to pump 200 during the inversion is returned from hydraulic pump 200 to compensator 350 through electric motor 300 between inversion phases. In this manner, hydraulic fluid is circulated between hydraulic pump 200 and compensator 350 through electric motor 300. In other embodiments, the electric motor (e.g., motor 300) may include heat dissipation fins extending radially from the motor housing (e.g., housing 310) to enhance the transfer of thermal energy from the electric motor to the surrounding environment.

Referring now to FIGS. 3E and 3F, as previously described, compensator 350 provides a reservoir for hydraulic fluid, accommodates thermal expansion of hydraulic fluid in deliquification pump 100, provides hydraulic fluid for lubrication of motor 300 and hydraulic pump 200, and replenishes hydraulic fluid in pumps 110, 200 that may be lost to the surrounding environment over time (e.g., through leaking seals, etc.). Compensator 350 has a first or upper end 350*a* coupled to electric motor 300 and a second or lower end 350*b* coupled to separator 400. In addition, compensator 350 includes an outer housing 351 extending axially between ends 350*a*, 350*b*, an annular piston 370 disposed within housing 351, a biasing assembly 380 disposed within housing 351, and a support member or shoe 390 disposed within housing 351 at lower end 350*b*. Biasing assembly 380 is axially positioned between piston 370 and shoe 390, and biases piston 370 axially upward toward end 350*a*. A tubular conduit 395 extends axially through compensator 350 and is in fluid communication with tubular conduit 205 and separator 400.

Housing 351 includes an elongate tubular section 352, a first or upper end cap 353 closing off tubular section 352 at end 350*a* and coupling compensator 350 to motor 300, and a second or lower end cap 354 closing off tubular section 352 at end 350*b*. Section 352 and end caps 353, 354 define an internal chamber 360 within housing 351. Upper end cap 353 includes an axial throughbore 355 and a hydraulic fluid port 356, and lower end cap 354 includes a throughbore 357 and an annular shoulder 358. The upper end of throughbore 355 receives the lower end of conduit 205 (FIG. 3D) and the lower end of throughbore 355 receives the upper end of conduit 395 (FIG. 3E). Thus, throughbore 355 provides fluid communication between conduits 205, 395.

Piston 370 is disposed in chamber 360 about conduit 395. In this embodiment, piston 370 includes a piston body 371 extending radially from conduit 395 to housing 351 and a tubular member 372 extending axially from piston body 371 toward end 350*b*. Piston body 371 slidingly engages both conduit 395 and housing 351, and divides chamber 360 into a first or upper chamber section 360*a* extending axially from upper end cap 353 to piston 370 and a second or lower chamber section 360*b* extending axially from piston 370 to lower end cap 354. In this embodiment, piston body 371 includes a plurality of axially spaced radially inner annular seals 373 that sealingly engage conduit 205, and a plurality of axially spaced radially outer annular seals 374 that sealingly engage housing tubular section 352. Seals 373, 374 restrict and/or prevent fluid communication between chamber sections 360*a*, 360*b*.

Referring still to FIGS. 3E and 3F, shoe 390 is seated in chamber 360 against shoulder 358. In this embodiment, shoe 390 includes a central throughbore 391, a plurality of circumferentially-spaced axial ports 392 disposed about central throughbore 291, and an annular seat 393. Central throughbore 391 receives the lower end of conduit 395 and provides fluid communication between conduit 395 and throughbore 357 in lower end cap 354. Ports 392 provide fluid communication between throughbore 357 in lower end cap 354 and lower chamber section 360*b*. Throughbore 357 is in fluid communication with separator 400, and thus, conduit 395 and lower chamber section 360*b* are in fluid communication with separator 400 via central throughbore 391 and ports 392, respectively.

Chamber section 360*a* is filled with hydraulic fluid and chamber section 360*b* is filled with well fluids 15 from separator 400 via throughbore 357 and ports 392. Thus, as piston 370 moves axially within chamber 360 and the volume of section 360*b* changes, well fluids 15 are free to move into and out of section 360*b* via ports 358. The remainder of well fluids 15 output from separator 400 pass through bores 357, 391, conduit 395, bore 355, and conduit 205 to fluid end pump 110.

Tubular member 372 is disposed about biasing assembly 380 and defines a minimum axial distance between piston body 371 and lower end cap 354, thereby defining a maximum volume of chamber section 360*a*. In general, piston 370 is generally free to move axially within chamber 360; when piston 370 moves axially toward end cap 353, the volume of section 360*a* decreases and the volume of section 360*b* increases, and when piston 370 moves axially toward end cap 354, the volume of section 360*a* increases and the volume of section 360*b* decreases. However, tubular member 372 limits the axial movement of piston 370 toward end cap 354. Specifically, once tubular member 372 axially abuts end cap 354, piston 370 is prevented from moving axially downward.

Referring still to FIGS. 3E and 3F, biasing assembly 380 biases piston 370 axially upward toward end 350*a*. In this embodiment, biasing assembly 380 includes a plurality of axially spaced biasing members 381 and a plurality of annular biasing member guides 382, one guide 382 axially disposed between each pair of axially adjacent biasing members 381. Biasing members 381 and guides 382 are disposed about conduit 205 and are axially positioned between piston body 371 and shoe 390. The lower end of the lowermost biasing member 381 is seated against seat 393. In this embodiment, biasing members 381 are coil springs and guides 382 function to maintain the radial position and coaxial alignment of the coil springs 381, thereby restricting and/or preventing springs 381 from buckling within chamber section 360*b*.

Piston 370 is a free floating balance piston that moves in response to differences between the axial force applied by the hydraulic fluid pressure in section 360*a*, and the axial forces applied by biasing assembly 380 and well fluids pressure in section 360*b*. Specifically, piston 370 will move axially within chamber 360 until these axial forces are balanced. The hydraulic fluid in chamber section 360*a* is in fluid communication with motor housing 310 via end cap port 356, and is in fluid communication with hydraulic pump chambers 220, 230, 240 via clearances between pump housing end cap 213 and driveshaft shaft 298. Accordingly, if the volume, and associated pressure, of hydraulic fluid in pump 200, motor 300, and/or compensator 350 increases, it can be accommodated by compensator 350. Conversely, if the volume, and associated pressure, of hydraulic fluid in pump 200, motor 300, and/or compensator decreases (e.g., if any hydraulic fluid is lost due to seal leaks etc.), it can be replenished by hydraulic fluid from compensator 350.

As previously described, piston 370 moves axially within chamber 360 in response to differences between (a) the axial force applied by the hydraulic fluid pressure in section 360*a*, and (b) the sum of the axial force applied by biasing assembly 380 and the axial force applied by the well fluids pressure in section 360*b*. Thus, pressure of the hydraulic fluid in section 360*a* is equal to the pressure of well fluids in section 360*a* plus the pressure exerted by piston 370 on the hydraulic fluid in section 360*a* due to the axial force exerted by biasing assembly 380. LVP 100 is designed and configured such that springs 381 are in compression between piston 370 and end cap 354 and exert a positive pressure of about 3.0 bars on the hydraulic fluid in section 360*a* (via piston 370) above and beyond the pressure of the well fluids in section 360*b*. Section 360*a* is in fluid communication with chambers 220, 230, 240 of hydraulic pump 200, and thus, the hydraulic fluid in chambers 220, 230, 240 is also maintained at a positive pressure of about 3.0 bars above and beyond the pressure of well fluids in section 360*b*. Maintenance of a positive pressure of 3.0 bars on the hydraulic fluid in section 360*a* and chambers 220, 230, 240, regardless of the well fluids pressure, allows compensator 350 to push hydraulic fluid into bores 256, 253 when bores 256 are in fluid communication with chambers 220, 230, 240 via slots 272. It should also be appreciated that maintenance of the hydraulic fluid at a positive pressure above and beyond the pressure of the well fluids reduces the risk of well fluids in sections 121*a*, 125*a* penetrating into hydraulic fluid in sections 121*b*, 125*b*.

Referring now to FIG. 2, separator 400 has a first or upper end 400*a* coupled to lower end cap 354 of compensator 350, a second or lower end 400*b* opposite end 400*a*, and a tubular body 401 extending axially between ends 400*a*, 400*b*. Lower end 400*b* is closed, while upper end 400*a* is open and in fluid communication with conduit 205. In addition, body 401 includes a plurality of through holes or apertures 402 extending radially therethrough. A filter 403 extends across each hole 402 and is configured to allow fluid flow therethrough into body 401 while restricting and/or preventing the flow of solids above a certain size from flowing therethrough into body 401 and pump 100.

Referring now to FIGS. 1, 2, and 3A-3F, deliquification pump 100 is deployed by rigless deployment vehicle 30 to lift well fluids 14 from the bottom of relatively low pressure wellbore 20 to enhance production. Alternatively, pump 100 may be deployed on standard oilfield jointed tubulars with the use of a conventional workover rig. Well fluids 14, which may include solid, liquid, and gas phases, are sucked from the bottom of wellbore to separator 400, which filters the well fluids to remove at least a portion of the solids therein, and then supplies substantially solids-solids-free well fluids 15 (i.e., well fluids 14 minus the portion of the solids removed by separator 400) to pump 100. Well fluids 15 supplied from separator 400 are sucked into fluid end pump 110 via conduit 395, which passes through compensator 350, conduit 205, which passes through motor 300 and hydraulic pump 200, and well fluids flow passage 116 in distributor 115. This arrangement serves as another means for removing heat from motor 300 and hydraulic pump 200 as the well fluid 15 passes through the interior of motor 300 and hydraulic pump 200. In particular, this arrangement forces countercurrent flow of well fluids 15 upward through the center of motor 300 and hydraulic pump 200, and hydraulic fluid downward about conduit 205 through motor 300 and hydraulic pump 200, thereby offering the potential for enhanced cooling. This design also eliminates the radially outer shroud commonly used in most conventional electric submersible pumps, which limits the minimum pump outside diameter and minimum size casing through which the pump can be deployed. Further, the center well fluid 15 flow design disclosed herein provides a direct, unrestricted path to fluid end pump 110. Well fluids 15 supplied to fluid end pump 110 enter pump sections 121*a*, 125*a* via inlet valves 520 of upper and lower valve assemblies 500, 500', and are pumped to the surface 11 through outlet valves 560, coupling 45, and conduit 40.

Fluid end pump 110 is driven by hydraulic pump 200, and hydraulic pump 200 is driven by electric motor 300. Conductors within or coupled to conduit 40 provide electrical power downhole to motor 300, which powers the rotation of motor driveshaft 320, hydraulic driveshaft 298, and wobble plates 270. As plates 270 rotate, hydraulic fluid in pump chambers 220, 230 is cyclically supplied to pistons 255 via slots 272, compressed in pistons 255, and then passed to distribution system 130 of fluid end pump 110 via branches 215, 216 and passages 214, 113. Hydraulic fluid distribution system 130 alternates the supply of pressurized hydraulic fluid to chamber sections 121*b*, 125*b*, thereby driving the reciprocation of fluid end pump pistons 600, 600'. Use of hydraulic pump 200 in conjunction with fluid end pump 110 offers the potential to generate the relatively high fluid pressures necessary to force or eject relatively low volumes of well fluids 15 to the surface 11. In particular, hydraulic pump 200 converts mechanical energy (rotational speed and torque) into hydraulic energy (reciprocating pressure and flow), and is particularly deigned to generate relatively high pressures at relatively low flowrates and at relatively high efficiencies. The addition of fluid end pump 110 allows for an isolated closed loop hydraulic pump system while limiting wellbore fluid exposure to fluid end pump 110. This offers the potential for improved durability and reduced wear. The fluid end pump only has minor hydraulic losses and for the most part is a direct relationship to the pressure output of the hydraulic system. In addition, the variable speed output capability of the system allows for variable pressure and flow output of the fluid end pump.

In general, the various parts and components of deliquification pump 100 may be fabricated from any suitable material(s) including, without limitation, metals and metal alloys (e.g., aluminum, steel, inconel, etc.), non-metals (e.g., polymers, rubbers, ceramics, etc.), composites (e.g., carbon fiber and epoxy matrix composites, etc.), or combinations thereof. However, the components of pump 100 are preferably made from durable, corrosion resistant materials suitable for use in harsh downhole conditions such steel. Although deliquification pump 100 is described in the context of deliquifying gas producing wells, it should be appreciated that embodiments of deliquification pump 100 described herein may also be used in oil wells. Further, although fluid end pump 110, pistons 600, 600' of pump 110, and distribution system 130 are described within the context of deliquification pump 100 for removing fluids from a subterranean well, it should be appreciated that embodiments of fluid end pump 110, pistons 600, 600', distribution system 130, or combinations thereof can be used in other applications or pumping devices.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A reciprocating pump for pumping a fluid, the pump comprising:

a pump housing having a central axis, a first end, a second end opposite the first end, a first piston chamber, and a second piston chamber axially spaced from the first piston chamber;

a first valve assembly coupled to the first end of the pump housing, wherein the first valve assembly includes an inlet valve and an outlet valve;

a second valve assembly coupled to the second end of the pump housing, wherein the second valve assembly includes an inlet valve and an outlet valve;

a first piston moveably disposed in the first piston chamber, wherein the first piston divides the first piston chamber into a first section extending axially from the first piston to the first valve assembly and a second section axially positioned between the first piston and the second piston, wherein the inlet valve of the first valve assembly is configured to supply the fluid to the first section of the first piston chamber and the outlet valve of the first valve assembly is configured to exhaust the fluid from the first section of the first piston chamber;

a second piston moveably disposed in the second piston chamber, wherein the second piston divides the second piston chamber into a first section extending axially from the second piston to the second valve assembly and a second section axially positioned between the second piston and the first piston, wherein the inlet valve of the second valve assembly is configured to supply the fluid to the first section of the second piston chamber and the outlet valve of the second valve assembly is configured to exhaust the fluid from the first section of the second piston chamber;

a connecting rod extending axially through the pump housing, wherein the connecting rod has a first end coupled to the first piston, a second end coupled to the second piston, and a throughbore extending axially from the first end of the connecting rod to the second end of the connecting rod;

wherein each piston includes a piston housing and a decompression valve disposed in the corresponding piston housing;

wherein the decompression valve of the first piston has a closed position preventing fluid communication between the first section of the first piston chamber and the throughbore of the connecting rod and an open position allowing fluid communication between the first section of the first piston chamber and the throughbore of the connecting rod, wherein the decompression valve of the first piston is biased to the closed position;

wherein the decompression valve of the second piston has a closed position preventing fluid communication between the first section of the second piston chamber and the throughbore of the connecting rod and an open position allowing fluid communication between the first section of the second piston chamber and the throughbore of the connecting rod, wherein the decompression valve of the second piston is biased to the closed position;

wherein the decompression valve of the first piston includes a valve member extending axially from the piston housing of the first piston and configured to axially impact the first valve assembly to transition the decompression valve of the first piston to the open position;

wherein the decompression valve of the second piston includes a valve member extending axially from the piston housing of the second piston and configured to axially impact the second valve assembly to transition the decompression valve of the second piston to the open position.

2. The reciprocating pump of claim 1, wherein the first piston further comprises:

a valve housing seated in the piston housing of the first piston, wherein the valve member of the first piston is moveably received by the valve housing of the first piston and has a radially outer surface including an annular shoulder;

an end cap secured to the first end of the first piston, wherein the end cap has a radially inner surface including an annular valve seat;

a biasing member disposed within the valve housing of the first piston and configured to bias an annular shoulder of the valve member of the first piston into engagement with the valve seat of the end cap of the first piston;

wherein the annular shoulder of the valve member of the first piston engages the valve seat of the end cap of the first piston when the decompression valve of the first piston is in the closed position, and wherein the annular shoulder of the valve member of the first piston is axially spaced from the valve seat of the end cap of the first piston when the decompression valve of the first piston is in the open position;

wherein the second piston further comprises:

a valve housing seated in the piston housing of the second piston, wherein the valve member of the second piston is moveably received by the valve housing of the second piston and has a radially outer surface including an annular shoulder;

an end cap secured to the first end of the second piston, wherein the end cap has a radially inner surface including an annular valve seat;

a biasing member disposed within the valve housing of the second piston and configured to bias an annular shoulder of the valve member of the second piston into engagement with the valve seat of the end cap of the second piston;

wherein the annular shoulder of the valve member of the second piston engages the valve seat of the end cap of the second piston when the decompression valve of the second piston is in the closed position, and wherein the annular shoulder of the valve member of the second piston is axially spaced from the valve seat of the end cap of the second piston when the decompression valve of the second piston is in the open position.

3. The reciprocating pump of claim 2, wherein the valve member of the first piston has a first end extending axially from the piston housing of the first piston and a second end disposed in the valve housing of the first piston; and wherein the valve member of the second piston has a first end extending axially from the piston housing of the second piston and a second end disposed in the valve housing of the second piston.

4. The reciprocating pump of claim 2, wherein the first piston further comprises a guide seated within the valve housing of the first piston and extending axially into the valve member of the first piston, wherein the biasing member of the first piston is disposed about the guide of the first piston; and Wherein the second piston further comprises a guide seated within the valve housing of the second piston and extending axially into the valve member of the second piston, wherein the biasing member of the second piston is disposed about the guide of the second piston.

5. The reciprocating pump of claim 2, wherein each valve member comprises:

an annular recess on the outer surface of the valve member proximal to the first end of the valve member;

a port extending radially inward from the annular recess; and a counterbore extending axially from the second end of the valve member;

wherein the annular recess, the port, and the counterbore of the valve member of the first piston are in fluid communication;

wherein the annular recess, the port, and the counterbore of the valve member of the second piston are in fluid communication.

6. The reciprocating pump of claim 5, wherein each piston housing has a radially outer surface and a radially inner surface;

wherein the valve housing of the first piston has a first end proximal to the end cap of the first piston and a second end seated against an annular shoulder of the radially inner surface of the piston housing of the first piston;

wherein an annular passage disposed between the first end of the valve housing of the first piston and the end cap of the first piston is in fluid communication with the throughbore of the connecting rod;

wherein the valve housing of the second piston has a first end proximal to the end cap of the second piston and a second end seated against an annular shoulder of the radially inner surface of the piston housing of the second piston;

wherein an annular passage disposed between the first end of the valve housing of the second piston and the end cap of the second piston is in fluid communication with the throughbore of the connecting rod.

7. The reciprocating pump of claim 6, wherein the annular recess of the valve member of the first piston is in fluid communication with the throughbore of the connecting rod when the decompression valve of the first piston is in the open position, and the annular recess of the valve member of the first piston is not in fluid communication with the throughbore of the connecting rod when the decompression valve of the first piston is in the closed position; and wherein the annular recess of the valve member of the second piston is in fluid communication with the throughbore of the connecting rod when the decompression valve of the second piston is in the open position, and the annular recess of the valve member of the second piston is not in fluid communication with the throughbore of the connecting rod when the decompression valve of the second piston is in the closed position.

8. The reciprocating pump of claim 2, wherein each piston housing has a radially outer surface and a radially inner surface;

wherein each piston housing comprises:

an annular recess on the radially outer surface of the piston housing; and a drain port extending radially from the annular recess to the radially inner surface of the piston housing;

wherein the annular recess and the drain port of each piston is in fluid communication with the throughbore of the connecting rod.

9. The reciprocating pump of claim 8, wherein the first piston further comprises:

a first plurality of annular seals mounted to the radially outer surface of the piston housing of the first piston and axially positioned between the first end of the piston housing of the first piston and the annular recess of the first piston; and a second plurality of annular seals mounted to the outer surface of the piston housing of the first piston and axially positioned between the second end of the piston housing of the first piston and the annular recess of the first piston;

wherein the first piston further comprises:

a first plurality of annular seals mounted to the radially outer surface of the piston housing of the second piston and axially positioned between the first end of the piston housing of the second piston and the annular recess of the second piston; and a second plurality of annular seals mounted to the outer surface of the piston housing of the second piston and axially positioned between the second end of the piston housing of the second piston and the annular recess of the second piston.

* * * * *